US009869135B1

(12) United States Patent
Martin

(10) Patent No.: US 9,869,135 B1
(45) Date of Patent: Jan. 16, 2018

(54) SUCKER ROD APPARATUS AND METHODS FOR MANUFACTURE AND USE

(71) Applicant: RFG TECHNOLOGY PARTNERS LLC, Sarasota, FL (US)

(72) Inventor: Jonathan R. Martin, Oklahoma City, OK (US)

(73) Assignee: RFG Technology Partners LLC, Sarasota, FL (US)

( * ) Notice: Subject to any disclaimer, the term of this patent is extended or adjusted under 35 U.S.C. 154(b) by 814 days.

(21) Appl. No.: 13/921,588

(22) Filed: Jun. 19, 2013

Related U.S. Application Data

(60) Provisional application No. 61/662,422, filed on Jun. 21, 2012.

(51) Int. Cl.
*E21B 17/10* (2006.01)
*E21B 17/00* (2006.01)
*E21B 17/02* (2006.01)

(52) U.S. Cl.
CPC ..... *E21B 17/00* (2013.01); *E21B 17/02* (2013.01); *E21B 17/10* (2013.01); *E21B 17/1042* (2013.01)

(58) Field of Classification Search
CPC ..... E21B 17/00; E21B 17/10; E21B 17/1042
See application file for complete search history.

(56) References Cited

U.S. PATENT DOCUMENTS

| | | | | |
|---|---|---|---|---|
| 2,604,364 | A | 7/1952 | Ward | |
| 4,997,039 | A | 3/1991 | Sable | |
| 5,119,876 | A * | 6/1992 | Sable | E21B 17/1071 166/241.2 |
| 5,247,990 | A * | 9/1993 | Sudol | E21B 17/1042 166/241.3 |
| 6,084,052 | A | 7/2000 | Aufdermarsh et al. | |
| 8,414,776 | B2 | 4/2013 | Hale | |
| 2007/0051510 | A1 * | 3/2007 | Veneruso | E21B 43/128 166/244.1 |

* cited by examiner

*Primary Examiner* — Robert E Fuller
(74) *Attorney, Agent, or Firm* — Pedigo Law Firm PLLC; Paul Pedigo; Heather Seitz

(57) ABSTRACT

A sucker rod string improved by the use of wear resistant, high temperature resistant, fiber-reinforced phenolic composite materials as centralizing guides on sucker rods and couplings, both molded on the rod and prepared as snap-on couplings for in-the-field use, and on magnet rod inserts, both rod box and pin magnet rod inserts, in which the thermosetting composites are used as sleeves, encapsulating housings, and centralizing guides. The magnet rod inserts and couplings are designed to be machined so that worn phenolic composite can be removed and replaced with fresh composite without removing or damaging the magnet. Processes are disclosed for integrating composite thermoset molding into sucker rod, coupling, and magnet rod insert manufacture and for refurbishing used components of a sucker rod string.

17 Claims, 34 Drawing Sheets

SUCKER ROD APPARATUS AND METHODS FOR MANUFACTURE AND USE

CROSS-REFERENCE TO RELATED APPLICATION

This application claims the benefit of priority based on U.S. Provisional Patent Application Ser. No. 61/662,422 filed in the United States Patent and Trademark Office on Jun. 21, 2012, entitled "Sucker Rod Apparatus And Methods For Manufacture And Use," which is hereby incorporated by reference in its entirety.

FIELD OF THE INVENTION

This invention relates to sucker rod pumping systems of the type commonly used to extract crude petroleum and natural gas from underground reservoirs; more specifically, the invention relates to methods of manufacturing and using sucker rod components and to modifications and attachments to the sucker rod system to improve overall well performance.

BACKGROUND OF THE INVENTION

Sucker-rod pumping is a long established method for artificially lifting crude petroleum and natural gas. In oil wells and in free-flowing gas wells, sucker rod pumping is used to lift liquids in the well, including crude oil in an oil well and water or other liquids that can fill up and block a free-flowing gas well. The components of a sucker-rod pumping system are immediately recognizable world-wide, especially the horse head and walking beam that commonly form the above-ground components of the subsurface pumping system. The above-ground components normally include a prime mover for providing driving power to the system, including gasoline and diesel engines and electric motors; a gear reducer for obtaining the necessary torque and pumping speed; a mechanical linkage for converting rotational motion to reciprocating motion, which includes the walking beam; a polished rod connecting the walking beam to the sucker-rod string; and a well-head assembly, sometimes referred to as a "Christmas tree," which seals on the polished rod to keep fluids, including both natural gas and crude petroleum, within the well and includes a pumping tee for removing oil and gas to flow lines for storage and processing. Below ground, the downhole equipment may include a well hole casing; production tubing within the casing and through which the oil is withdrawn; a rod string centrally located within the downhole tubing and composed of sections of sucker rods coupled to provide the necessary mechanical link between the polished rod and the subsurface pump; a pump plunger typically comprising a traveling ball valve and connected directly to the rod string to lift the liquid in the tubing; and a pump barrel, which is the stationary cylinder of the subsurface pump and contains a standing ball valve for suction of liquid into the barrel during the upstroke. The downhole equipment may also include a sinker bar, which is a heavily weighted section of the rod string typically placed immediately above the pump plunger to drop the plunger quickly and with less vibration on the down stroke, thereby increasing pumping speed and efficiency.

Sucker rod sections typically vary in length depending on the well conditions and may be present in sections that are from shorter "pony rods" of 2 to 10 feet, particularly near the top of the well, to longer rods of 25 or 30 feet long or more, coupled to extend thousands of feet into the ground to reach an underground oil reservoir. The sucker rod sections typically have a long and slender central shaft portion with externally threaded "upset" ends, also called "pins," of somewhat larger diameter to strengthen the joint. Sucker rods are joined end-to-end by much shorter, internally threaded, couplings or "rod boxes." In the usual case, the coupling is of somewhat larger diameter than the long and slender shaft section of sucker rod in between couplings and may be of the same or larger diameter than the largest diameter of the sucker rod upsets. The larger diameter couplings are sometimes called "full sized couplings" and typically are designated by the initials "FS."

Crude oil passes along the outside diameter of the sucker rod and around the couplings in the annular space between the sucker rod string and the inner surface of the production tubing in which the sucker rod string is contained. Natural gas typically flows in the annular space defined by the exterior surface of the production tubing and the inner surface of the well casing.

The sucker rod string, comprising couplings and rod segments, is surprisingly flexible. Tubing deviations from straight line are common and may include wells that have horizontal terminal segments. Lengthy sucker rod strings frequently abrade against the side of the production tubing and can wear the tubing and the sucker rod string and may result in breaking the rods and couplings. Pumping efficiency is reduced by frictional losses and down time for repairs and the repairs can be costly.

Numerous efforts have been made over the years to reduce abrasion, the impact of sucker rod and coupling wear, including the sucker rod and couplings wearing through the production tubing, and breaks in the rod string. For example, sucker rods and couplings may have centralizer guides with radially extending fins that contact the interior surface of the production tubing to space the rod from the tubing. The spaces between the fins provide flow channels for crude oil. Couplings may be specially shaped or covered to increase resistance to abrasion and wear.

It would be desirable to develop longer lasting, more efficient, tougher sucker rod strings that break less frequently, require less maintenance, and perform better in lifting crude oil and other fluids, including water. Water and other fluids can impede the free flow of natural gas, especially in the casing surrounding the production tube. It would also be desirable to develop such sucker rod strings that are readily and easily integrated into existing systems for pumping crude oil and into processes for the manufacture of sucker rods, couplings, and other components of the sucker rod string.

SUMMARY OF THE INVENTION

The invention provides sucker rod systems, sucker rod and coupling components, including new magnet rod inserts and centralizing guides and methods for making sucker rods, couplings, and components that exhibit increased wear resistance, are reconditionable and reusable, thereby reducing capital investment, especially for expensive magnets, and are easily integrated in whole or in part into existing sucker rod systems and sucker rod manufacturing processes.

Tough, abrasion resistant plastics may be used as centralizing guides on rod segments and couplings and as sleeves over magnets on sucker rods and on magnet rod inserts incorporated in the rod string to magnetically treat the fluids in the well, the guides and sleeves centering the rod segments, couplings, and magnet rods within the production tubing. The guides include radially extending fins for centering the rod or coupling component or magnet insert within the tubing and that are designed to provide a maximum flow area and erodible wear volume. Fiber-reinforced thermosetting plastics are preferred for the centralizing guides for rods and couplings, including sleeves for magnets. These guides may be provided by integrating magnet placement and centralizing guide and sleeve molding steps directly into the rod and coupling manufacturing process.

Ready-made, snap-on rod guides can be provided for installation in the field, including improved designs that use less plastic for centralizing and yet provide increased resistance to wear. The invention includes the rod and coupling combinations and the magnet inserts with centralizing guides along with processes for making and using them, including processes for integrating molding of rod and coupling guides directly into the rod manufacturing process and into processes for reconditioning used rods and couplings and providing for re-use of the more expensive magnets, magnet rod inserts, and box couplings.

In one embodiment, the invention provides a method for making sucker rod segments and couplings having centralizing guides molded thereon. In a typical rod manufacturing process, sucker rods are formed, upset pin ends are forged into place, the forged rods are annealed in a furnace at high temperatures to relieve stresses and strengthen the rod, external threads are cut in the pins, the pinned rods are treated to prevent rust and to protect the threads, and the finished rods are stacked on pallets for shipping. In the practice of the invention, the annealed rods may be conveyed to a staging oven where the rods are cooled to and held at about 300 to 400° F. The heated rods enter a mold at this stage of the process and rod guides are formed on the rod at preselected intervals. If magnets are desired on the rods, the magnets are installed after annealing and prior to molding rod guides and magnet sleeves onto the heated rods, the magnets and rods together being held at the molding temperature prior to molding. Thermosetting resin compositions are applied to the molds at a predetermined temperature and held for a sufficient time to cure onto the rod. Once cured, the rods are cooled and processed in a conventional manner to completion.

Alternatively, the rods may exit the annealing oven and enter a molding station, in the absence of a separate oven for heating to molding temperature. Induction heaters can heat the surfaces of the rod to about 300° F. to 400° F. (typically 350° F.) and can be provided in connection with each mold in the station, if desired. Rods may be retained in the molding station until the desired number of guides is applied, and the mold can be constructed to apply one guide or multiple guides simultaneously and multiple rods can be molded at the same time. In one arrangement, four to eight guides can be molded simultaneously on two or more rods.

Couplings may have guides applied by similar operations to those used to apply guides to new rods after initial forging and machining.

A similar process can be used to apply guides to reconditioned rods, to rods after manufacture and not as part of the manufacturing process, and couplings that have been cleaned and stripped. The invention provides a method for reconditioning rods, manufactured rods, and couplings and applying guides of the invention thereto by cleaning the rods or couplings as the case may be, heating the rods or couplings to a temperature sufficient for application of thermosetting resin to form the guide, applying the guides to the rods or couplings, cooling the rods or couplings, recoating the rods or couplings as needed, and otherwise preparing the rods and couplings for reuse as needed. If magnets are desired on the rods, then the magnets typically would be applied after forging or cleaning, stripping, and heating as the case may be, and prior to entering the molding station.

Magnets may be used in connection with the practice of the invention and incorporated as a rod string component to reduce corrosion, scaling, viscosity, pour point, and paraffin deposits and to improve pumping efficiency, in part by reducing the load applied to the entire rod string. An example of a particularly useful magnet is disclosed in U.S. patent application Ser. No. 12/682,013, which entered the national phase in the United States on Apr. 7, 2010 and was published on Aug. 19, 2010 as Pub. No: US 2010/0206732, the contents of which are incorporated herein by reference in their entirety. Magnets as described in U.S. Patent Application Pub. No: US 2010/0206732 can be mounted on any or all of a variety of rod string components of the invention, including the slender shaft of an otherwise conventional rod string segment, a coupling, or a relatively short rod string segment of about one foot in length and specifically intended to mount a magnet for coupling to the rod string, denoted herein as a "magnet rod insert." Each such magnet rod can be fitted with finned centralizing guides as an encapsulating and protective sleeve, the sleeve being made from reinforced thermosetting resin that is cured in place. The sleeve and rod combination for the magnet rod insert can be created with a defined wear portion of plastic resin over the magnet so that any remaining portion of the resin after wearing may be machined for removal and the magnet sleeve can be remolded and the magnet rod insert reused, thus making magnetic treatment of the crude oil more economical and more commercially viable by providing for reuse of the magnets and magnet rods.

In a typical installation, a magnet could be placed every 300 feet or so. If 25 foot rod segments are used, then a magnet could be installed after about every dozen rod segments, either as a magnet rod insert or on the shaft of an otherwise conventional rod segment. Of course, any desired spacing of magnets can be used, depending on the needs empirically determined for the particular well. Additional rod guides and couplings, in accordance with the invention or of conventional design, may be used in connection with the magnet insert or magnet mounted on a sucker rod shaft and each of these components may be used separately or together. Typically, rod guides will be placed throughout the length of the rod string on each rod segment as needed, one to eight or more on a 25 or 30 foot rod segment. For example, rod guides may be placed as frequently as desired in deviated well sections and in the transition areas from vertical or near vertical wells to horizontal or near horizontal wells.

Rods and coupling guides used today typically comprise thermoplastic compounds. However, in the practice of the invention, it has been determined that fiber-reinforced thermosetting plastic materials, including, for example, phenolic resins having fibers and minerals incorporated therein, are particularly useful and demonstrate greatly increased wear resistance, thought to be up to 100 times that of conventional guides.

The benefits of the invention are numerous. The magnets used in combination in the invention produce an intense magneto-hydrodynamic effect that is believed to disrupt crystallization and to keep paraffins and asphlatenes in solution, to substantially reduce the formation of corrosion and scale deposits, thus increasing daily oil and gas production, and to lower production viscosity and pour points, improving overall pump efficiency, reducing rod string loads, reducing or eliminating microbials and microbial-generated H2S, and helping achieve a more neutral pH within the production fluids. The thermoset molded guides and sleeves do not attract or retain abrasive sand, last many times longer than previous thermoplastic guides, and can be prepared using a portable molding plant with a continuous coiled rod system. The magnet rod inserts and box couplings can be manufactured so that they may be machined to remove old resin, refurbished with new thermoset molded guides, and reused.

Thus, the invention provides a method for making a sucker rod segment having fiber-reinforced phenolic plastic molded-on rod guides applied thereto in the sucker rod manufacturing process, which rod guides may be molded directly onto the rod string segment or over magnets applied to the rod string segment. Field-installable snap-on rod guides that incorporate thermoset fiber-reinforced resins may be structured so as to increase wear resistance of the guide and reduce the amount of resin used as compared to prior such guides, thus reducing costs and simultaneously increasing the flow area. The invention also provides rod couplings and magnet rod inserts that incorporate guides for centering the coupling or magnet insert formed from fiber-reinforced phenolic thermoset resins molded on the coupling or magnet segment, similar to the rod guides on the sucker rod segments and forming an encapsulating, centralizing, and protective sleeve for the magnet. These components may be used separately or together. For example, the invention includes a rod string comprising rod string segments having molded thereon at regular intervals rod guides of fiber-reinforced phenolic plastic resin; centralizing magnet rod inserts with similar fiber-reinforced phenolic sleeves over the magnet that also function as guides, hereinafter "magnet rods inserts," spaced between rod string segments at regular intervals or as otherwise required; and couplings joining sucker rod segments end-to-end having guides of fiber-reinforced phenolic plastic resin applied thereto as centralizers. Depending on whether the threads are internal or external, rod box or pin ends, the magnet rod inserts may double as couplings or may have couplings on each end for joining to a rod segment. These long-lasting, magnetic, and reconditionable rod string components provide for ready manufacture and installation in existing operations by incorporating the components directly into an existing rod string.

BRIEF SUMMARY OF THE DRAWINGS

Having described the invention in general terms, reference will now be made to the accompanying drawings, wherein.

DETAILED DESCRIPTION OF THE INVENTION

The invention will now be described more fully hereinafter with reference to the accompanying drawings, in which some, but not all concepts of the invention are illustrated. Indeed, the invention may be embodied in many different forms and should not be construed as limited to the examples set forth herein; rather, the embodiments provided in this disclosure are intended to satisfy applicable legal requirements.

Figure 1:
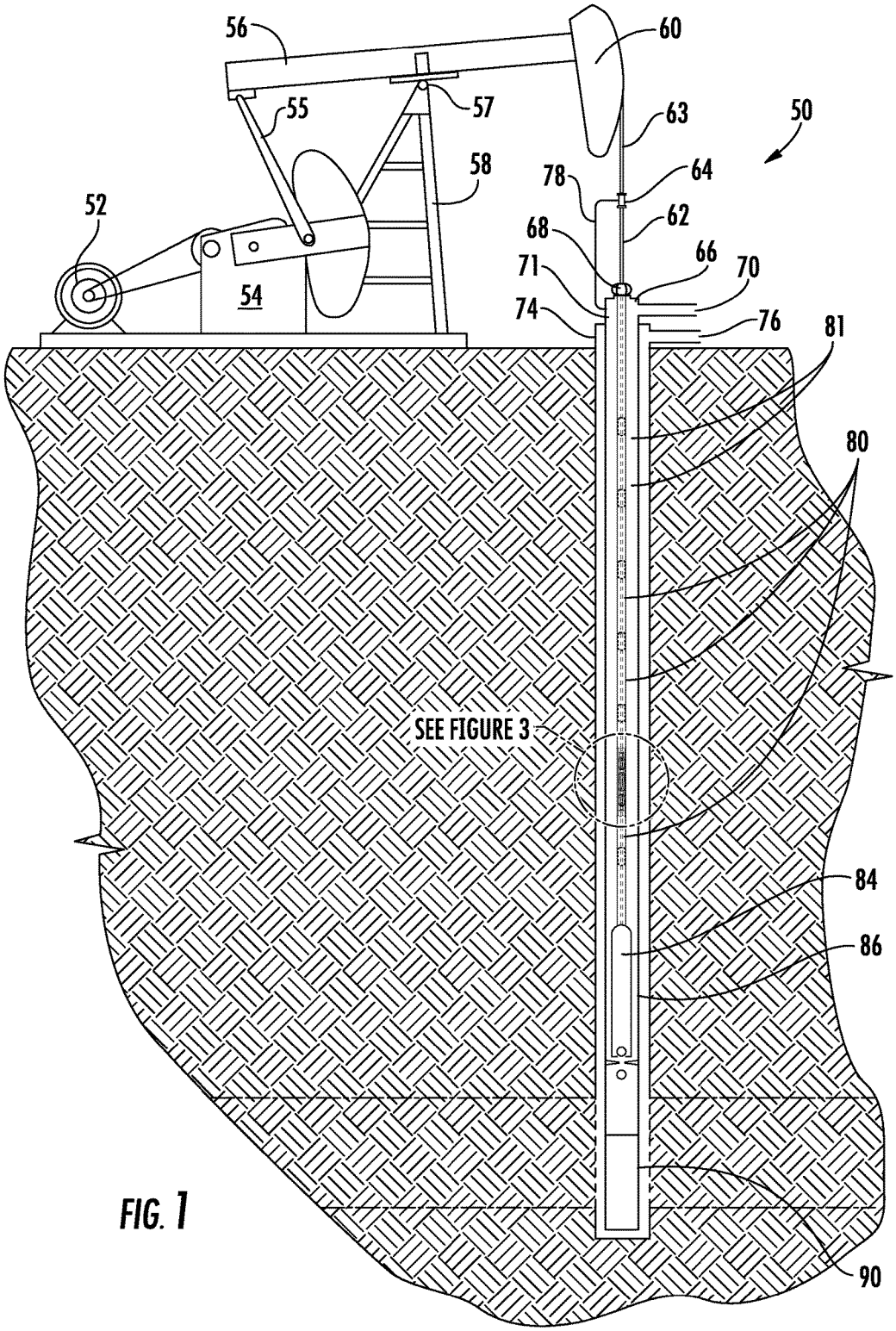
FIG. 1 illustrates in a schematic view the basic elements of a sucker-rod pumping system that includes an illustrative embodiment of the centralizing rod string of the invention shown in greater detail in FIG. 3 et seq.

FIG. 1 illustrates generally at 50 a sucker-rod pumping system having a motor 52 acting as a prime mover and generating rotational motion. The motor 52 may be powered by electricity, diesel fuel, propane, gasoline, or any other source of power. A gear reducer 54 reduces the speed of rotation and provides the torque necessary to drive the sucker-rod pumping system. The gear reducer connects a counterbalanced crank arm 55 to a walking beam 56 mounted on Samson posts 58. The walking beam pivots up and down about saddle bearing 57, converting the rotational movement of the prime mover to the alternating up-and-down movement for driving the sucker rod pumping system. A horse head 60 connects the walking beam to a polished rod 62 to reduce lateral stress on the rod string 80 so that the rod string of the sucker rod pumping system moves linearly up and down. A connector 64 connects the polished rod 62 to a hanger 63 associated with the horse head that travels with the rotation of the horse head to maintain the polished rod in a vertical orientation. A well head assembly 66, sometimes called a "Christmas tree," completes the above ground assembly as illustrated and provides a seal 68 against the polished rod to keep fluids in the well and a pumping tee 70 on production tubing 71 for removing oil to flow lines for storage or for further processing. Well bore casing 74 typically includes a vent 76 for removing fluids that may accumulate outside the production tubing, typically natural gas, and provides a convenient path for the removal of gas that separates from liquids and accumulates in the annular space between the well bore casing and the production tube.

Reciprocating up-and-down movement of powerful magnets within a production tube in a manner described in U.S. Patent Application Publication Pub. No.: US 2010/0206732 (Ser. No. 12/682,013) generates an alternating electrical Mv potential and a strong Magneto Hydrodynamic Effect (MHD). Movement of the rod string typically develops an alternating milli-volt current and MHD effect within the tubing, casing and production fluid. Overall, the combined Mv and MHD effects disrupt crystallization and keep paraffins and asphlatenes in solution, substantially reducing the formation of corrosion and scale deposits, thus increasing daily oil and gas production, and is believed to lower production viscosity and pour points, improving overall pump efficiency, reducing rod string loads, reducing or eliminating microbials and microbial-generated H2S, and helping achieve a more neutral pH within the production fluids. Electrical connection 78 is an optional component that, if used, can provide an additional means of distributing this current to assist in reducing electrolytic corrosion in the system.

By strategically placing these permanent magnets in the well, the effects on the fluids can be used to improve flow and pumping efficiency. Otherwise, the drop in pressure from the formation to the surface typically results in the production tubing becoming corroded, scaled, and clogged with precipitates, including paraffins and other products of crystallization. The magnets are believed to reduce hydrogen sulfide gas production compared to chemical treatments, to reduce production fluid viscosity compared to fluids produced in the absence of magnetic treatment, to reduce pour points, and to increase pump and production efficiency. Friction between the pump and polishing rod is reduced and it is believed that daily average oil production can be increased as much as 5%. It is believed that the improvements disclosed herein improve the performance overall of the rod string, reducing frictional losses all along the rod string and thus reducing the load on the string. The expense associated with magnet replacement is reduced by providing a way to reuse the magnets and magnet rods and to thereby increase the life cycle of the magnet rod assemblies and inserts used in this harsh environment.

Below ground, the production tube 71 fits coaxially within well bore casing 74 and extends deep into the ground to locate a petroleum reservoir. The polished rod 62 is connected to the rod string 80 comprising a plurality of sucker rod component sections that extend centrally of the production tube and form an annular space 81 through which pumped fluid, typically crude oil, travels. The sucker rod provides the mechanical link between the subsurface pump plunger 84 and the polished rod 62. The sucker rod string may be constructed of the length needed using sections of sucker rod and couplings as needed. One or more, and typically a plurality, of sucker rod sections may include magnets fitted thereto as described in U.S. Patent Application Publication Pub. No.: US 2010/0206732. The sucker rod may also include one or more magnet rod inserts with a centralizing sleeve as illustrated encircled and enlarged and in greater detail in FIG. 3 and following. The terminus of the sucker rod string is fitted with a pump plunger 84 as illustrated, which fits within a pump barrel 86 attached to the end of the production tubing and coextensive with the production tube. A gas anchor 90 may be included, if desired, at the terminus of the production tubing as well to separate gas from liquid and direct the gas to the annular space outside the production tubing. Anchors, not illustrated, typically are included at the terminus of the casing and production tubing to secure their location within the well.

It should be recognized that other arrangements can be used for sucker rod pumping and for other methods and apparatus for pumping oil, water, or other in-well liquids and to free up the flow of natural gas in an otherwise free-flowing gas well. The embodiments described herein can be used in connection with any of these and for treating other fluids. In the specific example of a sucker rod system, centralizing rod guides, centralizing couplings, sucker rods with or without magents, and magnet rod inserts with centralizing guide sleeves as described form components of the sucker rod string and may be used in combination or separately as desired.

Figure 2:
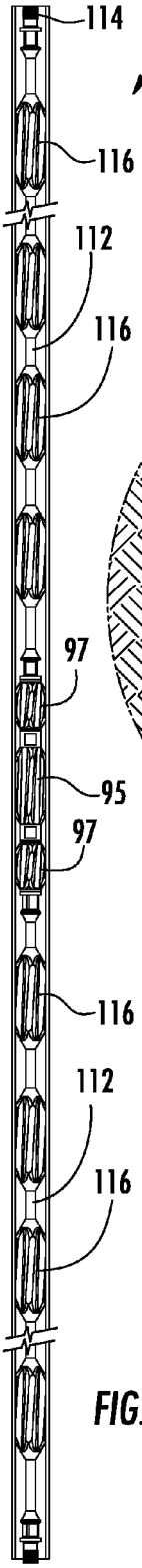
FIG. 2 illustrates in an enlarged view of a portion of production tubing from FIG. 1 that includes a portion of the centralizing rod string extending coaxially within the production tube and including centralizing rod guides and an intermediate centralizing "magnet rod" having external, or "pin" threads and associated centralizing couplings.

FIG. 2 illustrates generally at 110 a cutaway portion of one embodiment of the rod string 80 of FIG. 1, including identical upper and lower rod string segments 112, the upper rod segment 112 having a threaded upset end, or "pin" 114 for threaded coupling engagement of an adjacent rod string segment. It should be understood that neither the adjacent rod string segment nor the coupling are illustrated in the present view. Externally threaded upset pins 114 include increased diameter strengthening segments at each end of the sucker rod. A plurality of plastic thermoset molded centralizing rod guides 116 typically are evenly spaced along each rod string segment 112. The centralizing guides for sucker rods, magnets on sucker rods, and magnet rod inserts may be formed of conventional thermoplastic applied to the slender shaft portion of the rod, although in the practice of the invention, fiber-reinforced phenolic resin is preferred. The sucker rods 112 independently can vary in length from a couple of feet to 25 or 30 feet in length or other dimensions as desired, including one continuous rod from polish rod to pump. As shown, the rods each have four guides and the views are broken to indicate indeterminate length. Typically, about 4 to 8 guides would be used on a 25 or 30 foot rod sections, depending on the degree of deviation in the production tube.

Figure 3:
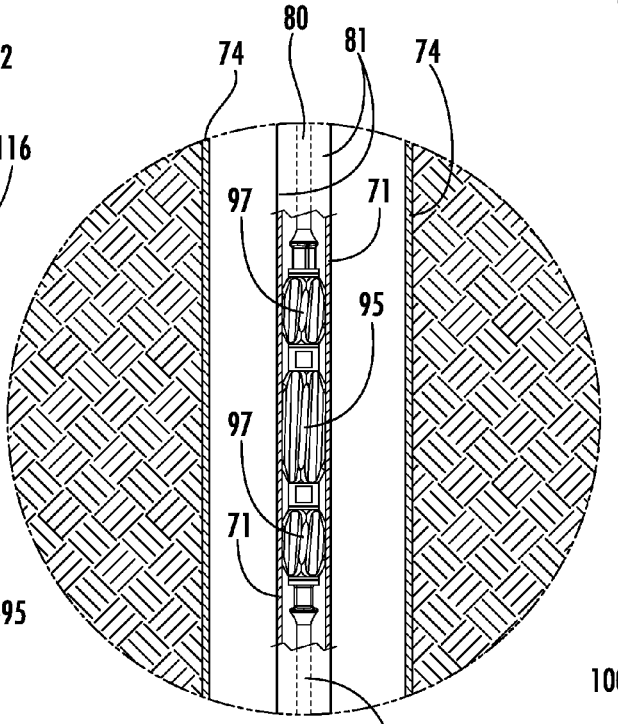
FIG. 3 illustrates in an enlarged view of a portion of FIG. 1 that includes, in section, an embodiment of a portion of the rod string, production tubing, and well casing that includes the centralizing rod string and production tubing section of FIG. 2, which is the pinned magnet rod and thermoset centralizing couplings.

In the central portion of FIG. 2 can be seen a rod string segment intermediate the rod segments 112 and having a thermoset-molded centralizing and pinned magnet rod insert 95, to be described in more detail below, intermediate two shorter thermoset molded centralizing couplings 97, one on each end of the magnet rod insert 95. This arrangement is shown in greater detail in the central portion of FIG. 3, and is included within the circular cutaway view of FIG. 1, which is enlarged for illustration in FIG. 3. FIG. 3 illustrates a magnet rod insert 95 intermediate centralizing couplings 97 on each end forming part of the rod string 80 and located intermediate sucker rod segments 112 (FIG. 2). Couplings 97 are rod box couplings having centralizing guides of reinforced thermoset resin applied thereto, which are high strength corrosion resistant steel couplings having internal threads for receiving the pinned, or externally threaded, ends of the sucker rods 112. Magnet rod insert 95 is pinned for coupling to the pinned sucker rods through couplings 97.

Rod string 80 is located centrally within the production tubing 71 and forms an annular space 81 between the production tubing and the sucker rod string 80. Production tube 71 is in turn centrally located within well bore casing 74, also illustrated in section and surrounded by the formation in which the well is embedded, the formation illustrated as a cross-hatched area. It can be seen that magnet rod insert 95 and couplings 97 have fins extending radially to the production tube inner surface to engage the tubing to keep the sucker rod string centered within the tube substantially to preclude metal to metal contact of the tubing, rods, and couplings and to define flow passages between them for the passage of crude oil. The centralizing magnet rod insert shown at 95 and the centralizing couplings at 97 beneficially have fiber-reinforced thermoset phenolic composite sleeves, as do the centralizing guides 116 on the sucker rods. It should be noted that the sleeves are coaxial with the sucker rod and do not interfere with, but enhance, the operation of the sucker rod in the production tube and the egress of oil from the underground reservoir to the surface.

Figure 4:
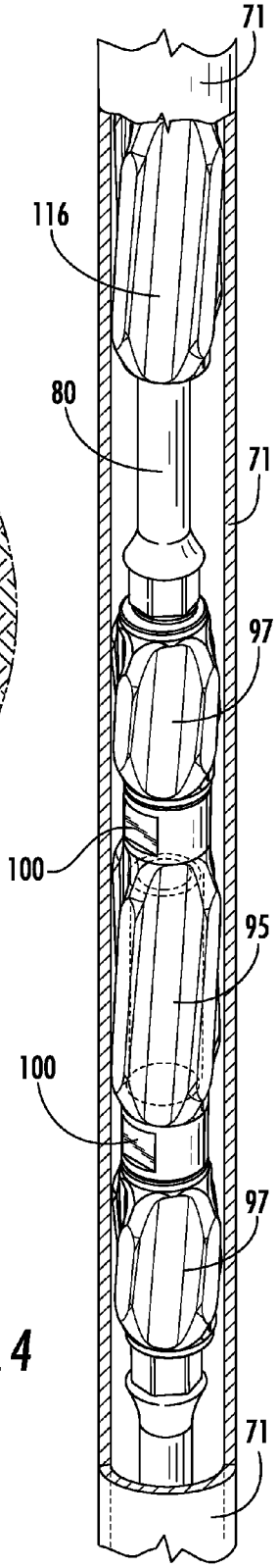
FIG. 4 is similar to FIG. 2 and illustrates an enlarged view of a portion of the production tubing and rod string of FIG. 1, including the pinned magnet rod and thermoset centralizing couplings illustrated in FIG. 3 and a small portion of the immediately adjacent portion of a sucker rod with centralizing guide, FIG. 4 also illustrating in shadow an embodiment of the placement of a magnet within a centralizing sleeve of the pinned magnet rod.

Turning now to FIG. 4, FIG. 4 illustrates a portion of the rod string 80 of FIG. 2 and that of FIG. 3 in somewhat more detail within a partial section through the production tube 71. The rod string includes an assembly of a magnet rod insert 95, the magnet rod having a sleeve of fiber and mineral reinforced thermoset molded resin mounted over a short segment of sucker rod that is connected to the rod string on each end by centralizing couplings 97 that desirably are covered with sleeves of similar thermoset forming guides. The magnet rod insert typically has the magnet mounted thereto and under the thermoset molded centralizing sleeve, as illustrated in shadow in FIG. 4. Wrench flats 100 provide for assembly of the components, illustrated in more detail in FIGS. 5 through 10. FIG. 4 also illustrates an additional portion of a rod guide 116 mounted on a longer section 112 (FIG. 2) of the sucker rod to which the coupling 97 is mounted intermediate the sucker rod and magnet rod insert.

Whether used in combination or separately, the components of a rod string as set forth herein reduce the load applied to an artificial lift system in which a sucker rod and couplings are used to create a rod string in a sucker rod pumping system having a production tube. Operational and frictional loads are reduced on the rod string, sinker bar, couplings and tubing, generally with increased daily fluid production and with less downtime to replace components, since the components can typically last longer.

Figure 5:
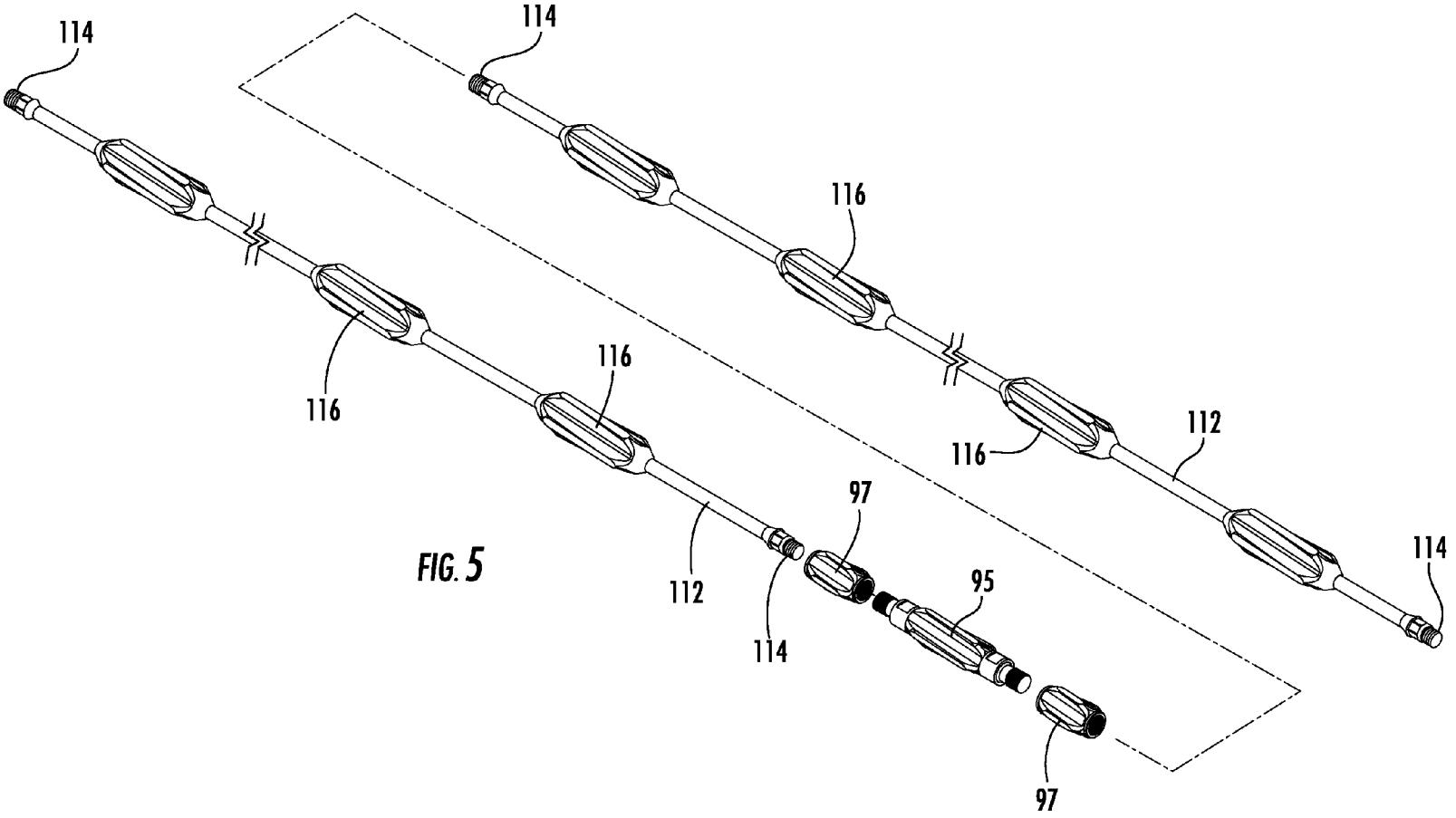
FIG. 5 illustrates an exploded perspective view of the embodiment of FIGS. 2 and 4 and includes the embodiment of FIG. 3 in exploded perspective.
Figure 6:
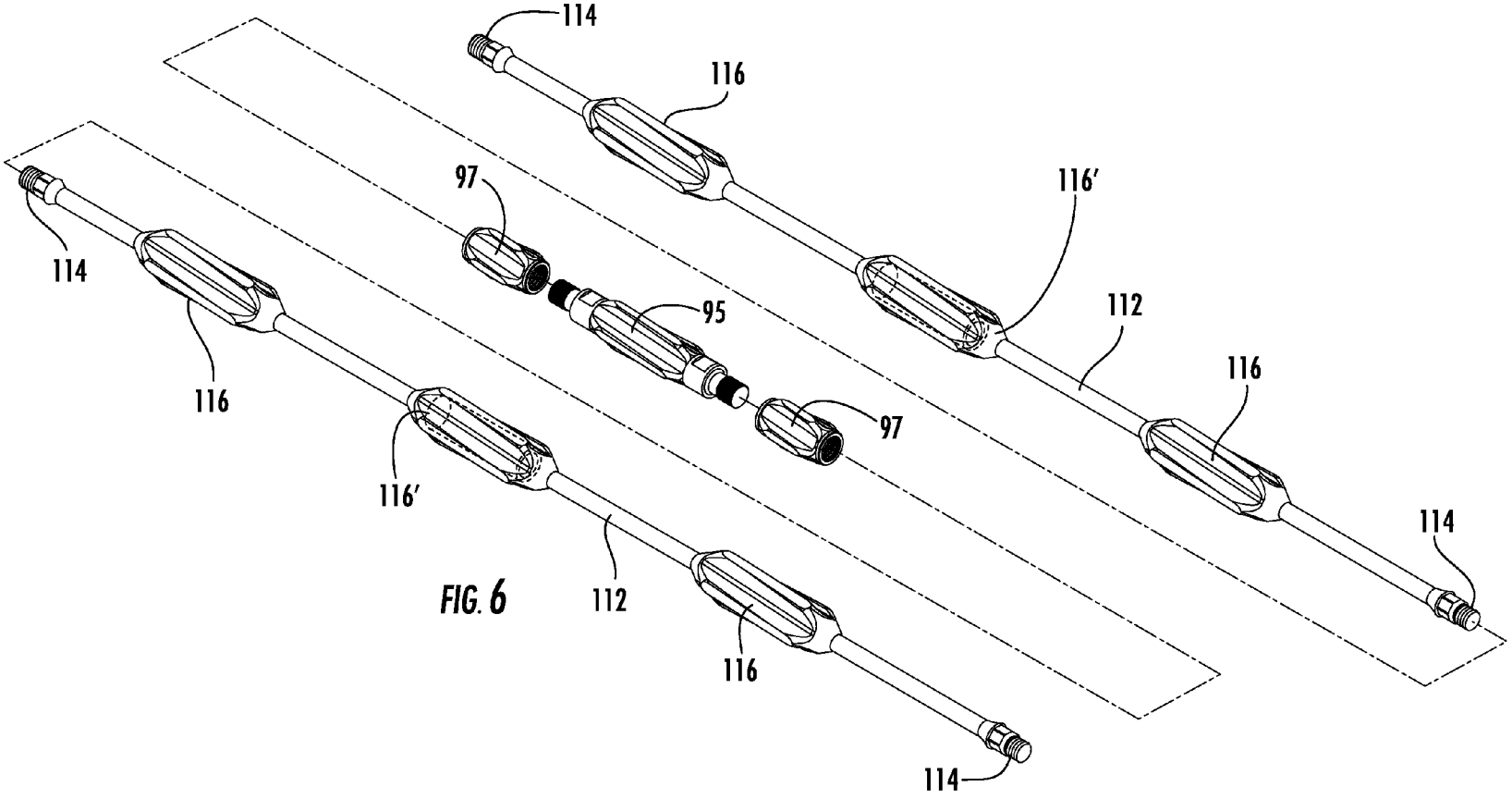
FIG. 6 illustrates an exploded perspective view of an alternative embodiment to that of FIGS. 2 through 5.

FIGS. 5 and 6 illustrate in exploded perspective a portion of a sucker rod string comprising sucker rod and magnet rod insert combinations of the invention with sucker rods of indeterminate length (FIG. 5, and see also FIG. 2) and four-foot "pony" sucker rods (FIG. 6), respectively. The sucker rods each include upset pin ends 114, multiple centralizing guides 116, a pinned magnet rod insert 95, and box coupling guides 97 threadedly joining the magnet rod insert and sucker rods end-to-end in coupling engagement. The sucker rods 112 of FIG. 6 have a mold-on guide adjacent each end and, in a central section thereof, centralizing guides 116' that are also sleeves for magnets mounted to the rod, which are shown in shadow within the guide. It should be recognized that magnets may be included at any location as desired on the sucker rod and at more than one location if desired. FIG. 6 should be considered in illustration and not in limitation of the invention. Typically, when magnet rod inserts 95 or their equivalent are used, then these may be spaced apart with multiple sucker rods 112 in between. Thus, rods 112 typically will not include magnets under the rod guides, although they may include magnets as desired if deemed necessary or desirable, depending on empirical determination for each well. In the absence of the magnet rod insets, then magnets normally are mounted on the sucker rod shaft under one or more rod guides as needed.

On 25 to 30 foot rods, thermoset molded centralizing rod guides normally would be installed throughout the rod string, as needed, depending on the severity of deviations of the well. Typically, from four to eight may be used on a 25 to 30 foot rod and one of these could also be used, every 300 feet or less as needed, as a sleeve for a magnet to seal the magnet against contact with production fluid.

Magnets, whether mounted on magnet rod inserts or on sucker rods, typically are placed every 300 feet or so, depending on well requirements. For example, a magnet rod insert may be placed at intervals of every dozen or so twenty-five foot rods. Alternatively, the magnet rod inserts could be placed every 75 to 150 feet or to the empirically determined requirements for the well. Also, magnets can be mounted to rods under sleeves and the magnet rod inserts not used at all, although it may be advantageous in reducing costs to employ the magnet rod inserts for ease of installation, replacement, or refurbishment. The magnets generate a magneto-hydrodynamic field extending 360° directly into the production fluids and also provide, on reciprocating movement of the rod string while in operation, a safe alternating My current directly into the fluids in the well.

Figures 7, 8:
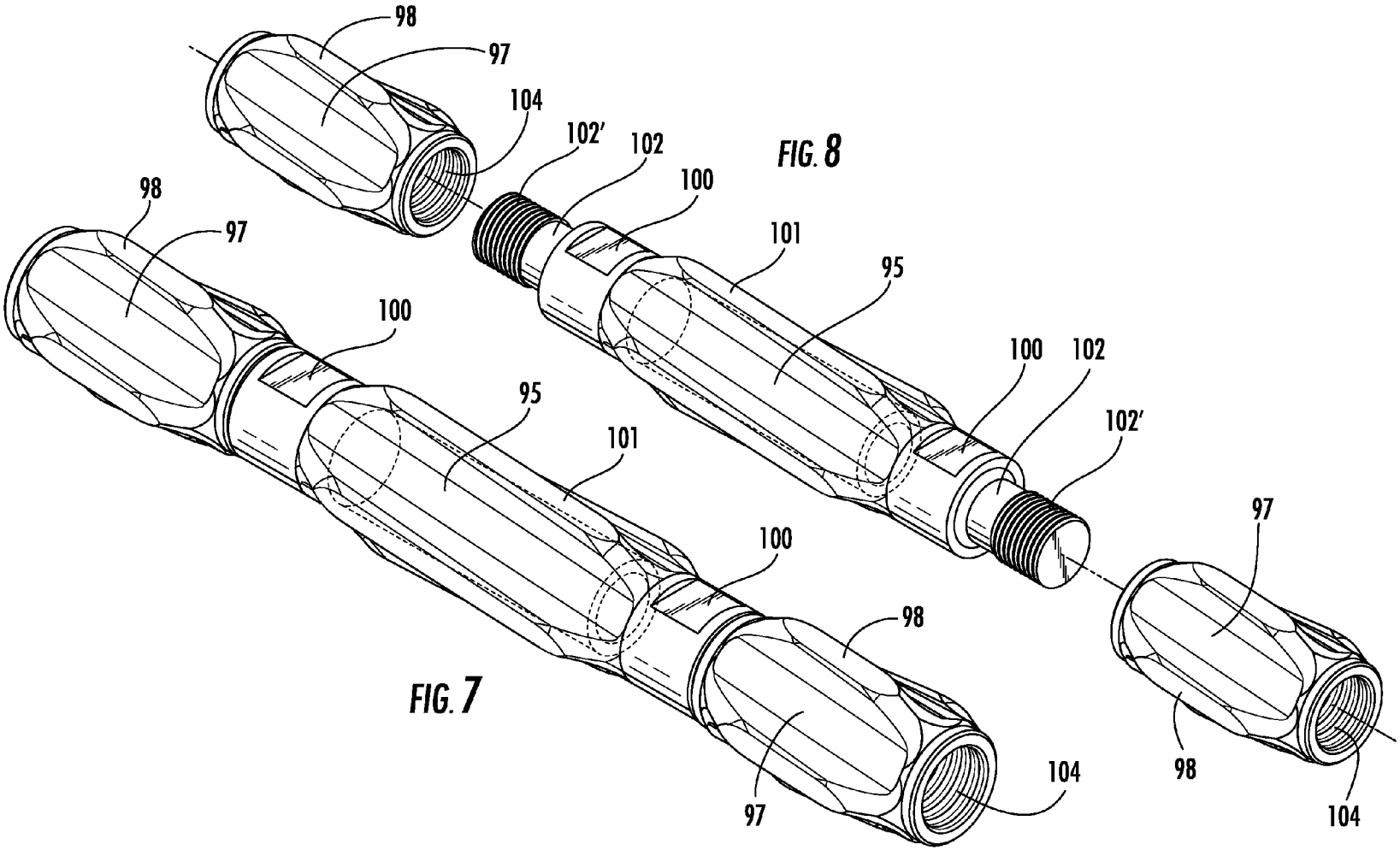
FIG. 7 illustrates in perspective an embodiment of the components of the rod string taken from FIG. 2, the pinned magnet rod and associated thermoset centralizing couplings isolated from the remainder of the rod string.
FIG. 8 illustrates the embodiment of FIG. 7 in exploded perspective.

FIGS. 7 and 8 illustrate in perspective and in exploded perspective, respectively, the embodiment of the pinned thermoset molded centralizing magnet rod insert 95 and thermoset molded centralizing couplings 97 illustrated in FIGS. 2 through 6 isolated from the rod string. The molded centralizing magnet rod insert illustrated generally at 95 comprises an outer thermoset plastic sleeve 101 having radially directed helical fins extending therefrom to engage the production tube wall and to provide a flow passage therebetween for crude oil to flow. The sleeve is fitted about a magnet, illustrated in shadow, mounted on a short segment of sucker rod 102 and having external threads 102' at each pin end with wrench flats 100 adjacent the threaded ends for gripping the rod segment for threadedly engaging couplings shown generally at 97. Couplings 97 comprise an internally threaded member 104 over which is mounted a thermosetting resin 98.

Figure 50:
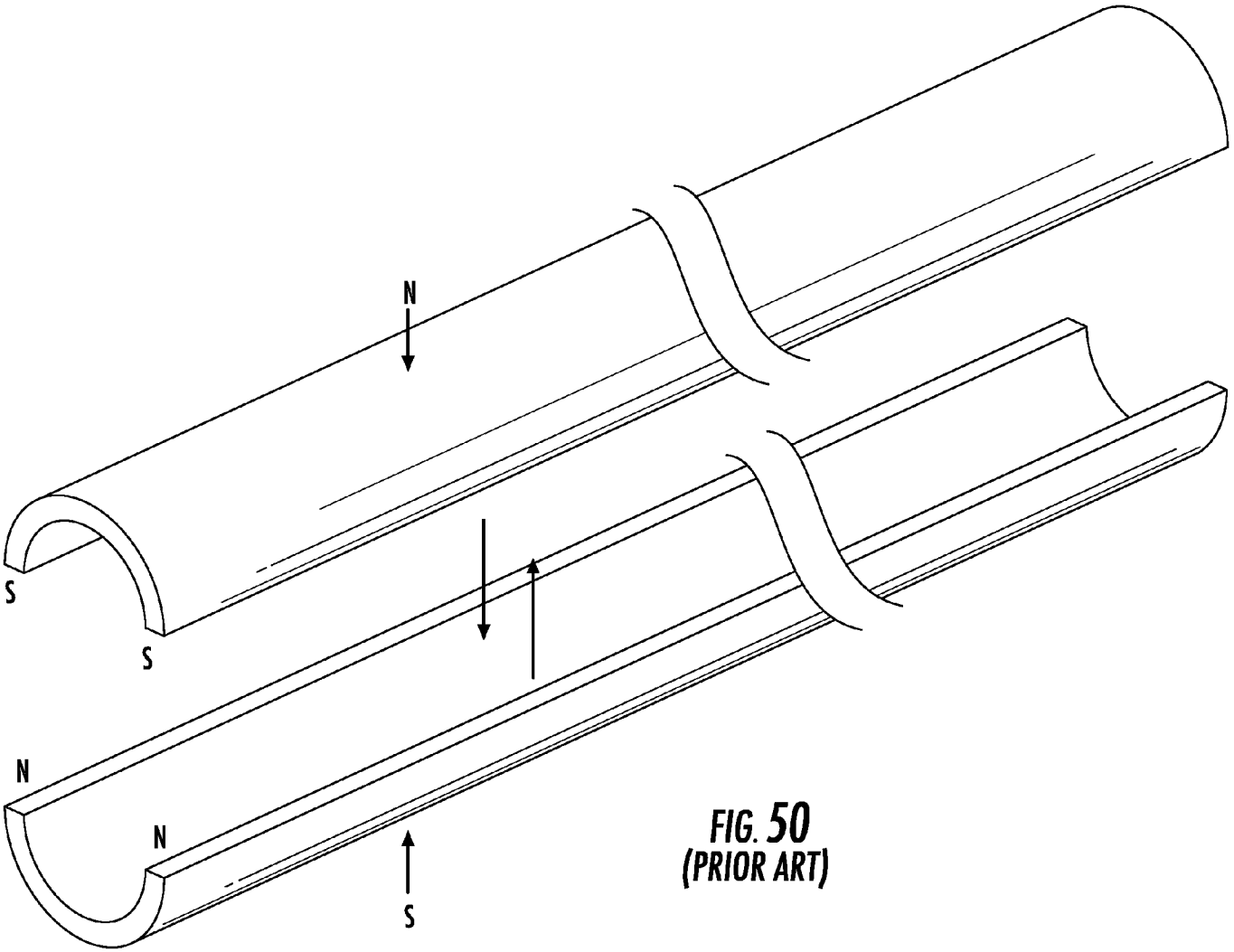
FIG. 50 (PRIOR ART)
FIG. 50 illustrates a prior art magnet that is useful in connection with the invention and is illustrated in shadow throughout the above figures.
Figure 51:
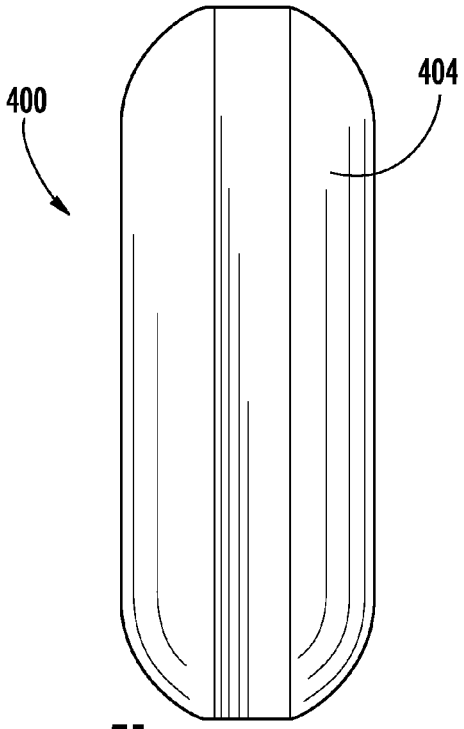
FIG. 51 (PRIOR ART)
FIGS. 51 through 56 illustrates a prior art sucker rod guide for field installation and having a C-shape spring steel clip with an opening for receiving and gripping the sucker rod, the clip embedded in a cylindrical synthetic rubber that having a slot over the opening in the clip and serving as a guide.
Figure 53:
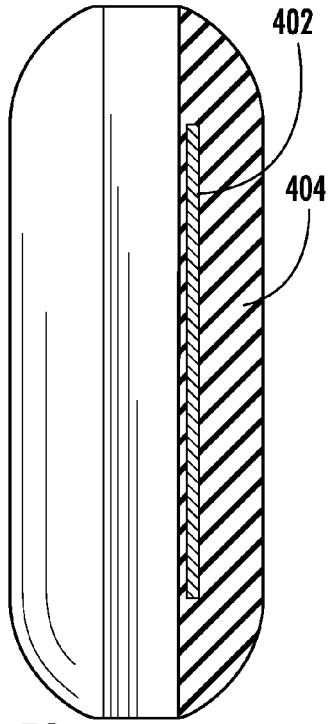
FIG. 53 (PRIOR ART)
Figure 52:
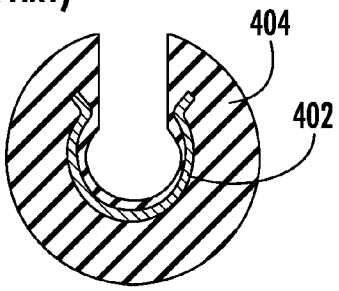
FIG. 52 (PRIOR ART)
Figure 54:
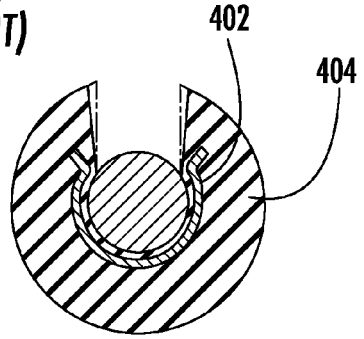
FIG. 54 (PRIOR ART)
Figure 55:
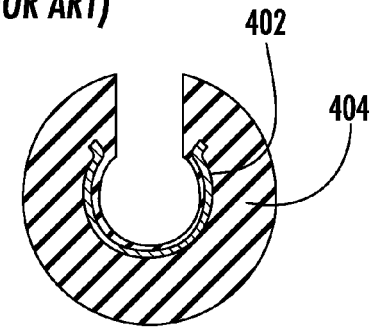
FIG. 55 (PRIOR ART)
Figure 56:
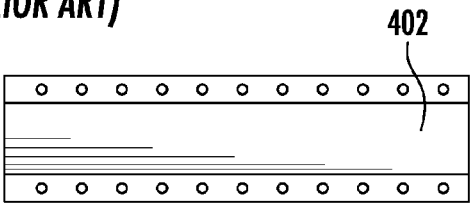
FIG. 56 (PRIOR ART)

The magnets, illustrated in shadow as hollow, longitudinally extended cylinders mounted over rod segment 102, typically are prepared from rare earth metals as set forth in co-pending U.S. Patent Application Pub. No.: US 2010/0206732. The magnet is illustrated in FIG. 50, labeled prior art. Magnets comprising neodymium and have proved to be useful and to provide an intense magnetic field or flux. The magnets typically comprise individual half cylinders, each half cylinder having a radially inner and a radially outer arcuate surface curved to form a semicircle for use in connection with the circular cross section of the magnet rod segment 102, although other arcuate shapes could be used, depending on the application. These arcuate surfaces extend axially in a longitudinal direction to form a half cylinder, one half cylinder labeled N for North and the other of a matched pair labeled S for South. The arcuate surfaces terminate transversely of the axis to form a pair of flat surfaces of opposite charge to that of the arcuate surfaces on the same half magnet, and are so labeled, the S flat surfaces connecting the N arcuate surfaces, and the N flat surfaces connecting the S arcuate surfaces.

Although these magnets are termed half cylinders, it should be understood that that term does not mean a portion of a cylinder that is cut in half, but refers to individually prepared and magnetized half cylinders that develop a high degree of monopolar character, including up to 90% monopolar characteristics. The magnets are diametrically charged, which is to say charged in a direction transverse to the longitudinal axis, and each of the inner and outer arcuate surfaces have the same polarity while the flat surfaces are of opposite polarity. The magnets are not in fact monopolar, and the flat longitudinal surfaces in each magnet are of opposite polarity to the arcuate surfaces in the same magnet. Thus, a "matched" pair of half cylinders means that the magnets are prepared as a pair for use together, each magnet exhibiting a high degree of monopolar character and having a polarity opposite that of the other.

When placed about the narrow section of a magnet rod insert or of a sucker rod section in a rod string, whether long or short, the flat surfaces of a matched pair of magnets magnetically contact each other to conjoin the magnets magnetically about the sucker rod. The flat surfaces need not be in direct contact so long as the intensity of the magnetic field is sufficient to fix the magnets on the sucker rod stem, coupling, or short rod segment.

It should be recognized that other magnets could potentially be used in connection with the practice of the invention; however, not necessarily with equivalent results.

Figure 9:
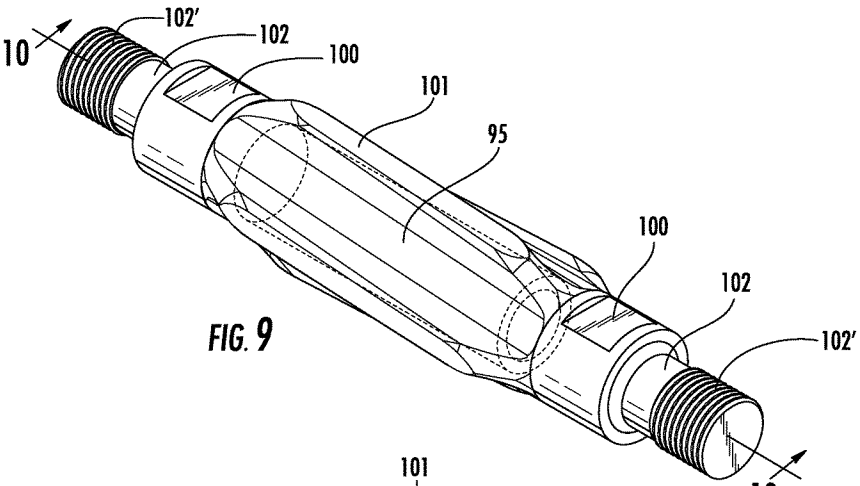
FIG. 9 illustrates in perspective the central portion of FIG. 8, which is the pinned magnet rod.
Figure 10:
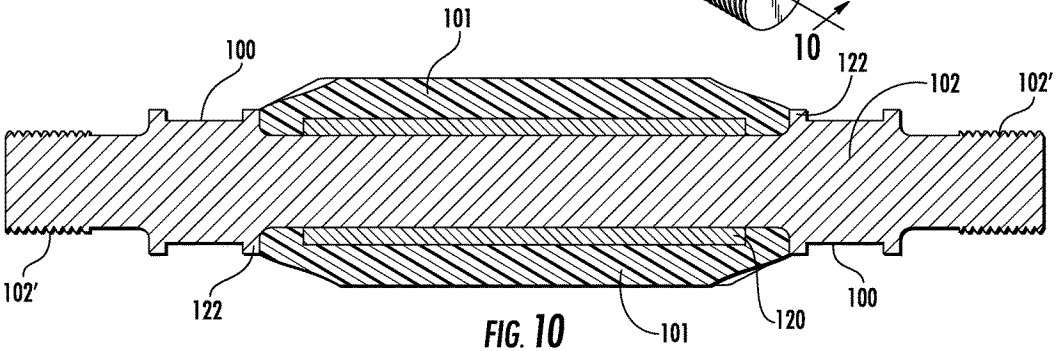
FIG. 10 illustrates a longitudinal section through the pinned magnet rod of FIG. 9 taken along line 10-10 of FIG. 9.

FIGS. 9 and 10 illustrate the isolated portion of the magnet rod insert 95 of FIGS. 2 through 8 in perspective and in longitudinal section, respectively. In section, magnet halves 120 are fitted to the shaft 102 of the magnet rod segment centrally of wrench flats 100. Wrench flats 100 are formed by the linear surfaces in between raised circumferential diameters of the shaft 102, the internal most one of which, 122, abuts the centralizing guide of thermosetting resin 101. The diameter 122 extends radially just beyond the outermost surface of the magnet 120, thus providing a stop for machining a used segment to the diameter defined by raised diameter 122 without damaging the magnet, which is an expensive component, and providing a way to refurbish the resin coating and renew the magnet rod insert without having to purchase a new magnet.

Figure 11:
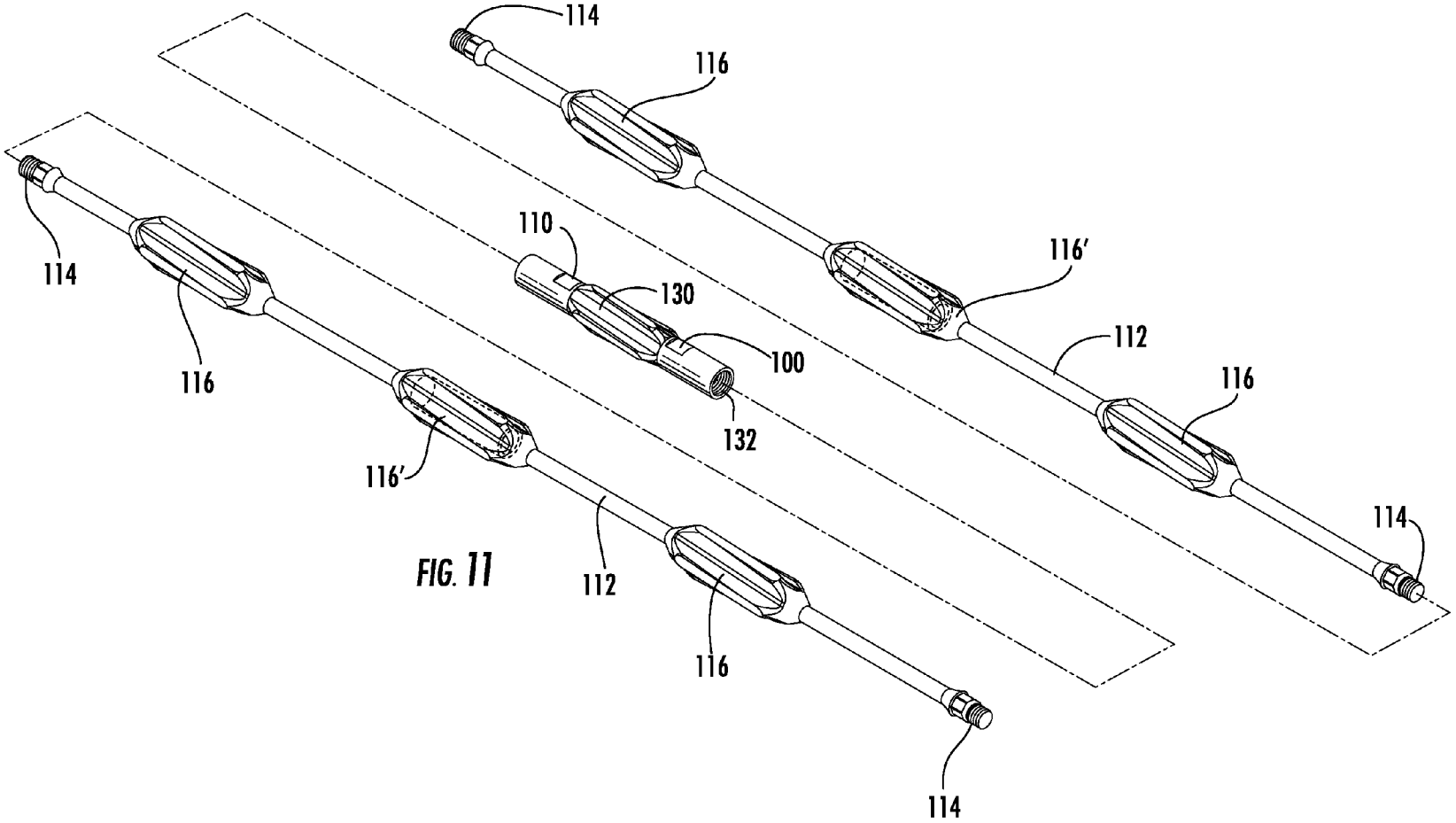
FIG. 11 illustrates in an exploded perspective view rod segments of a rod string including an alternative "box magnet rod" to the pinned magnet rod of the above Figures, in which the intermediate rod segment, the "magnet rod" has internal, or "box," threads for receiving the external, or "pin," threads of mated rod segments, thus eliminating the need for couplings, including thermoset centralizing couplings, at each end of the magnet rod.

FIG. 11 illustrates an alternative embodiment in which a magnet rod insert 130 is fitted with internal threads 132 and serves as both a centralizing coupling and a box magnet rod for placing a magnet between sucker rods. The remaining components, sucker rods 112, guides 116, magnet sleeves 116' and rod pins 114 are identical to those of FIG. 6.

Figure 12:
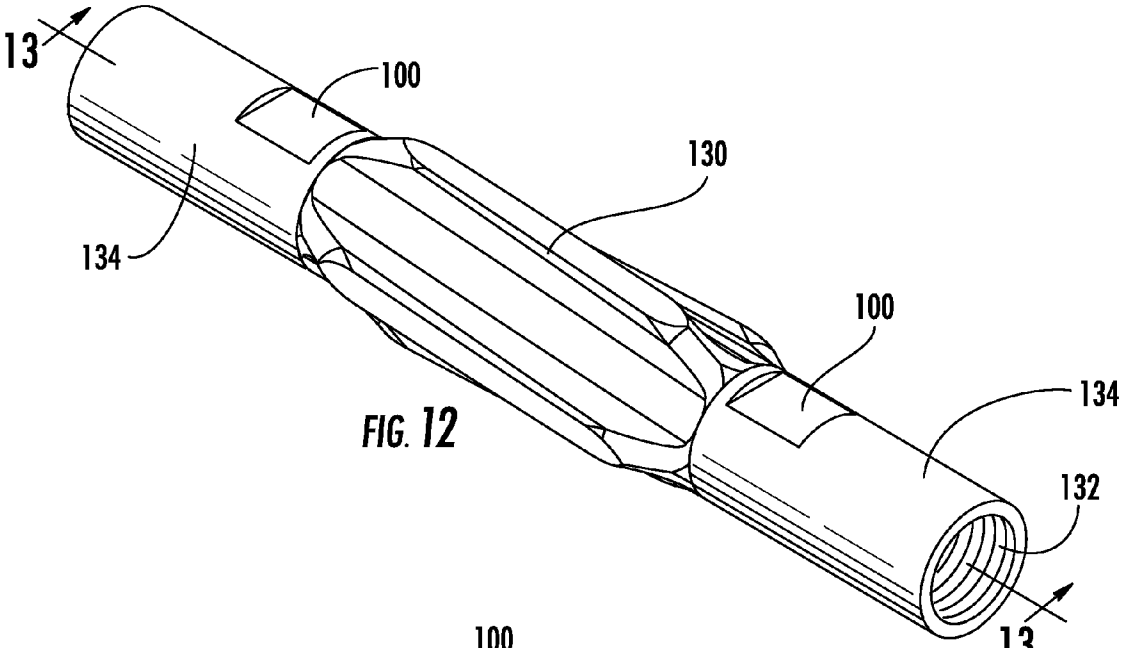
FIG. 12 illustrates in perspective the central box magnet rod segment of the sucker rod components of FIG. 11.
Figure 13:
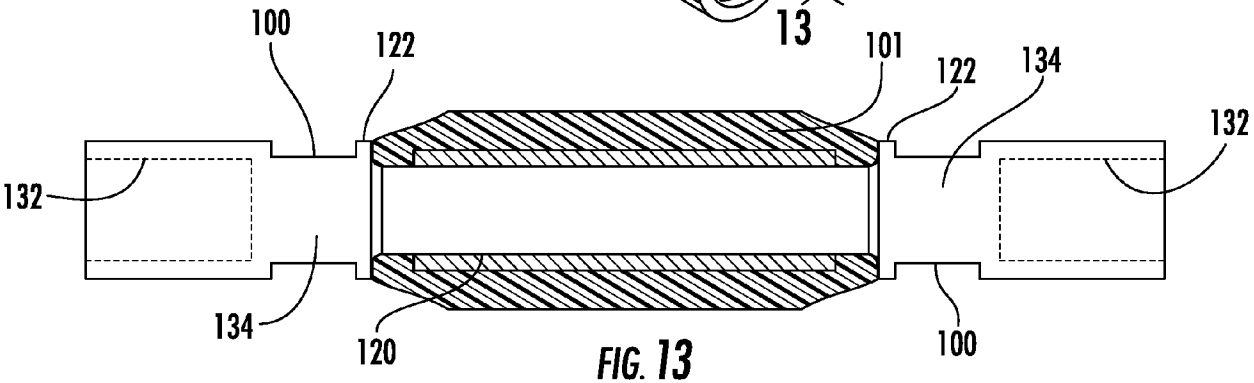
FIG. 13 illustrates a longitudinal section through the embodiment of FIG. 12 taken along line 12-12 of FIG. 13.
Figure 14:
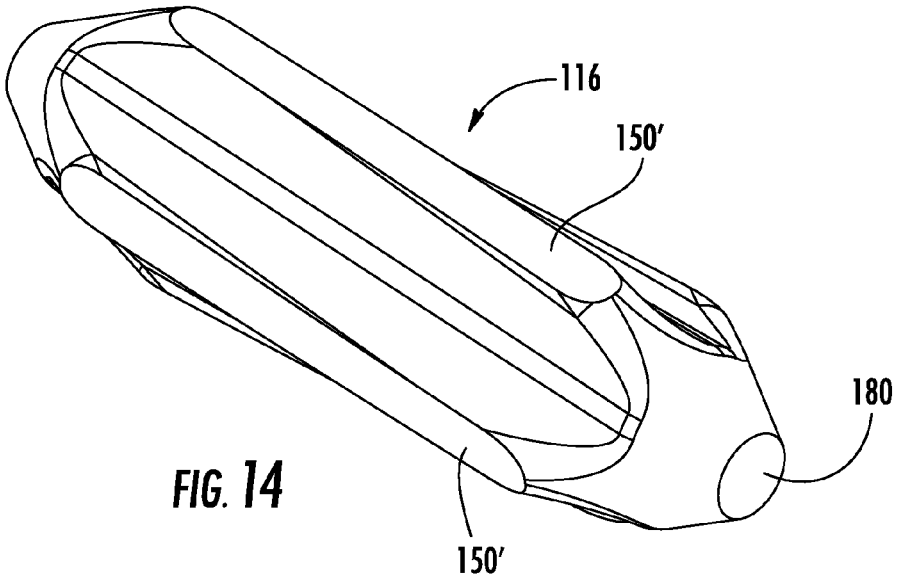
FIGS. 14, 15, and 16, and 17 illustrate, respectively, perspective, side plan, end plan and longitudinal sectional views of a sucker rod thermoset centralizing guide for use in connection with the invention, the section of FIG. 17 taken along line 17-17 of FIG. 16.
Figure 15:
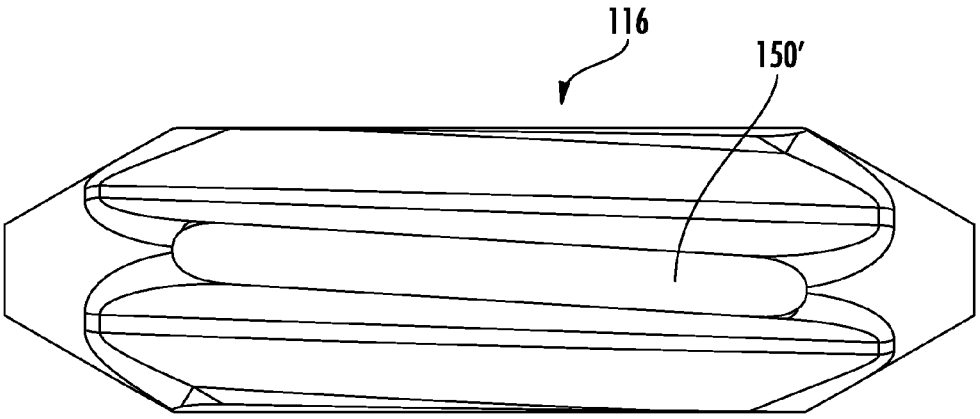
Figure 16:
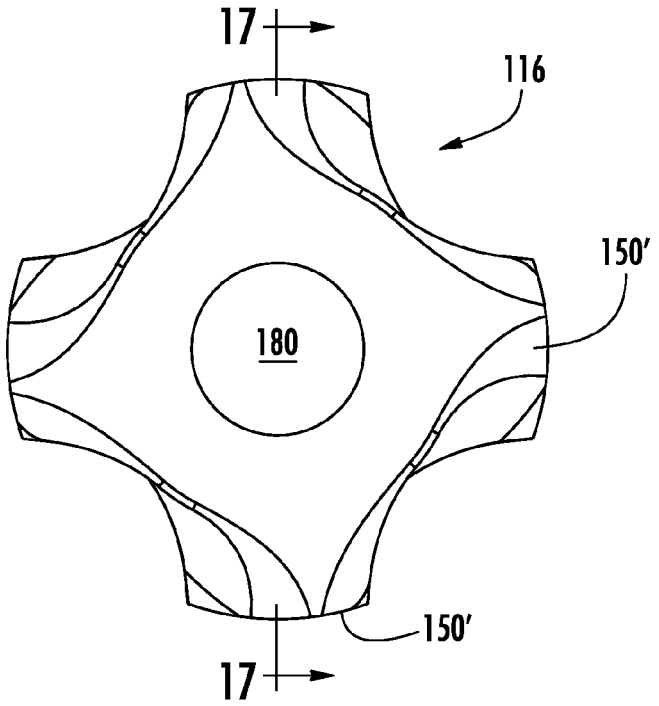
Figure 17:
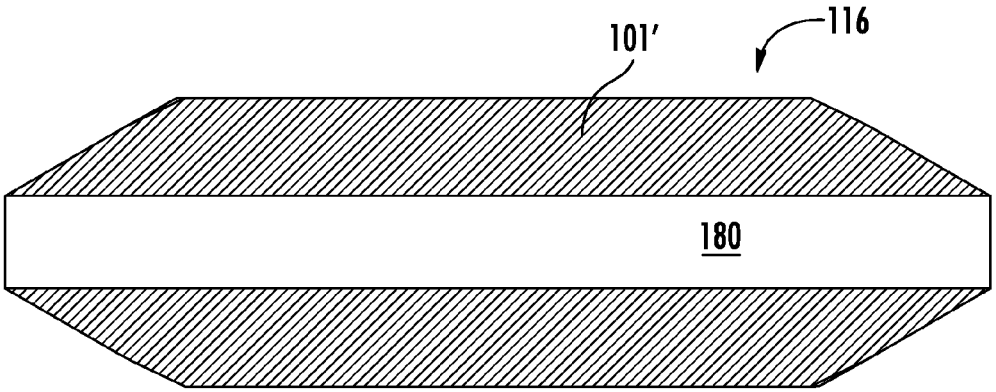
Figure 18:
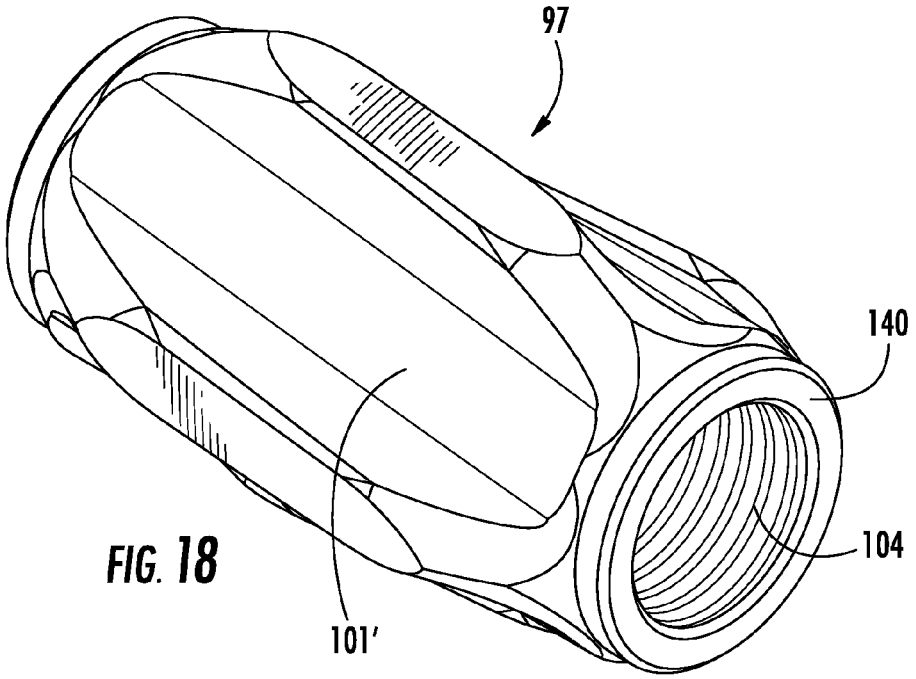
FIGS. 18, 19, 20 and 21 illustrate, respectively, perspective, side plan, end plan and longitudinal sectional views of a sucker rod thermoset centralizing coupling for use in connection with the invention, the section of FIG. 21 taken along line 21-21 of FIG. 20.
Figure 19:
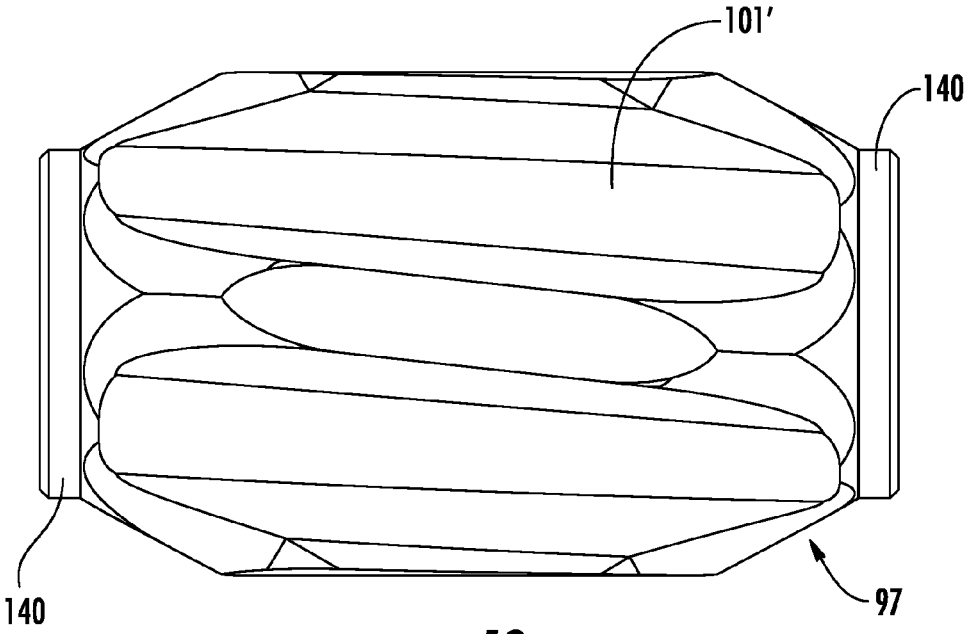

Box magnet rod insert 130 is illustrated in perspective and in longitudinal section in FIGS. 12 and 13, respectively. Similar to that shown in FIGS. 9 and 10, magnet rod insert 130 includes a thermosetting resin sleeve 101 mounted over a magnet 120 that is fitted over a reduced diameter portion of rod insert shaft 134. Radially extending diameter 122 adjacent wrench flat 100 provides a stop for machining the thermosetting resin for refurbishing the segment without removing or replacing the magnet or shaft.

FIGS. 14 through 17 illustrate generally at 116 a rod guide isolated from the rod 112 (FIGS. 2 through 6 and 11) on which it was formed and having radially and helically extended fins 150' for engaging the interior diameter of a production tube and defining channels for the flow of crude oil therebetween. A centrally located axial channel 180 is illustrated in the absence of the sucker rod. Whether a rod guide or a coupling guide, a box magnet rod insert guide, or a pinned magnet rod insert guide, the fins and channels should be constructed to maximize erodible area and minimally interfere with crude oil flow, thus increasing wear time and optimizing flow.

The thermosetting resin used in the practice of the invention for the various guides typically will comprise a polymer composite matrix, especially a fiber reinforced polymer composite matrix. Any suitable cross-linked polymer, elastomer, epoxy, polytetrafluoroehtylene or thermosetting composite resin should be useful, most especially phenolics. It should be recognized that ceramic, metal, and carbon composite matrixes may also be used, though not necessarily with equivalent results. Fiber reinforcement may be selected from glass fiber, carbon fiber, Kevlar fiber, basalt, fruit fiber, wool fibers, wood fibers, or other materials. Particulates, including minerals, and nanocomposites may also be used, although not necessarily with equivalent results. A thermosetting fiber reinforced composite matrix that has proved useful comprises glass fiber and minerals embedded in a phenolic resin. One or more of carbon black, coal dust, graphite, mica, talc, and wood flour may be used in the thermoset composition. The centralizing guides may be formed from thermosetting resins by any of several processes, including compression molding, injection molding, transfer molding, and others.

Figure 20:
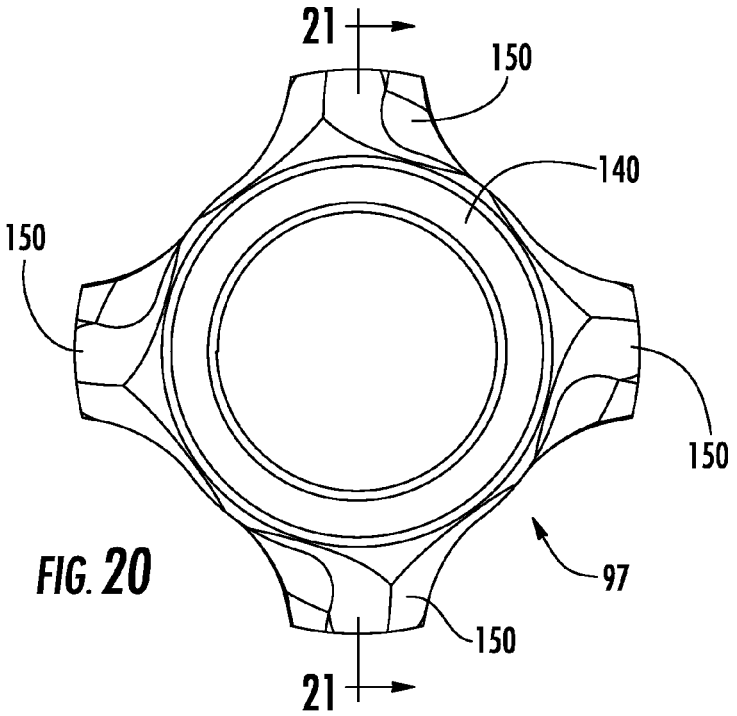
Figure 21:
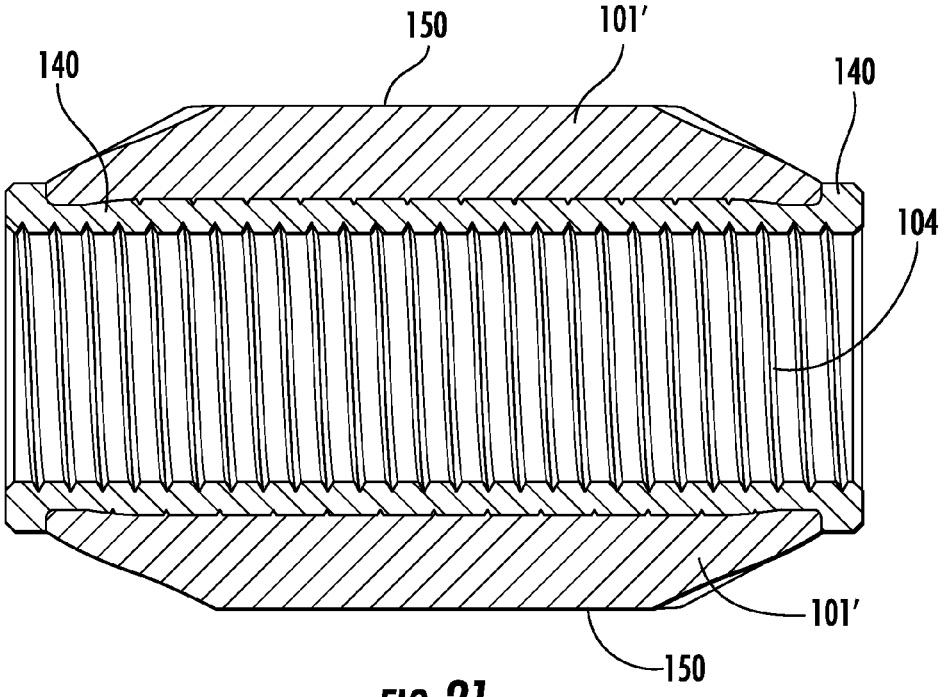

FIGS. 18 through 21 illustrate various views of the internally threaded centralizing coupling shown generally at 97 and in FIGS. 2 through 8, the coupling having a thermosetting resin 101' applied to coupling body 140 to create the centralizing coupling. Internal threads 104 provide for connection to externally threaded rod segments, including pinned magnet rods and sucker rods. The end plan view of FIG. 20 illustrates the centralizing guide having four radially extending and helical fins 150, though more or less may be used, and typically three to four, to provide centralizing in the absence of blocking liquid flow in the spaces created between a production tube and the fins. Typically, the fins are helical, though it should be understood that alternative designs may be used, including, for example, straight-line longitudinally directed radial fins.

Figure 22:
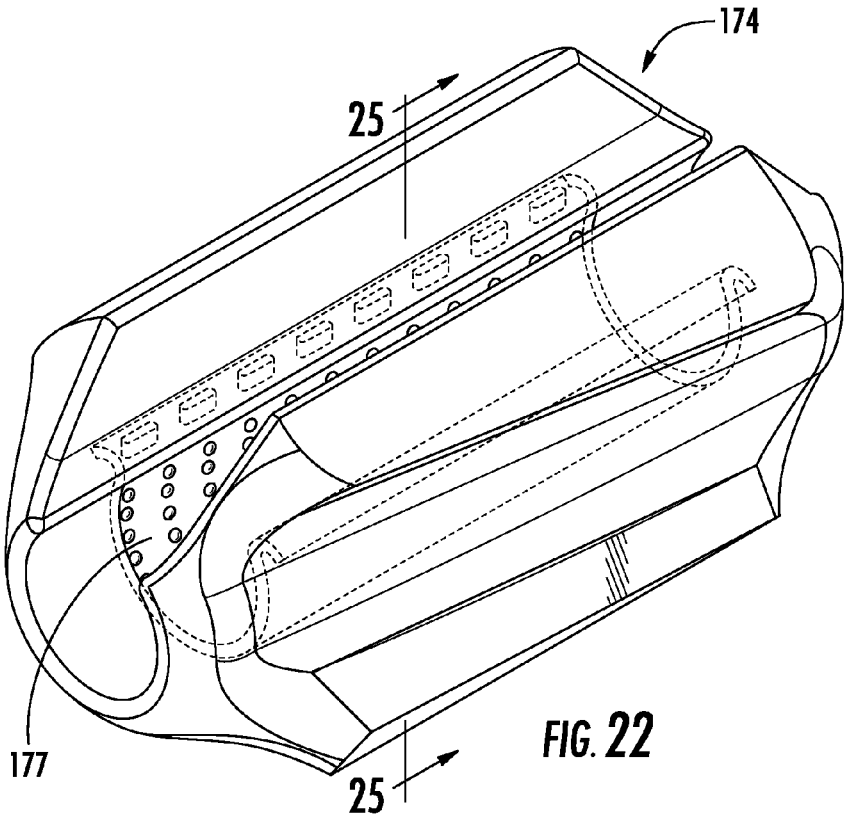
FIGS. 22, 23, 24, and 25 illustrate, respectively, perspective, side plan, end plan and longitudinal sectional views of a sucker rod field-installable thermoset centralizing guide with a heavy-duty corrosion-resistant metal elastic insertion snap-on clip for use in connection with the invention, the section of FIG. 25 taken along line 25-25 of FIG. 22.
Figure 23:
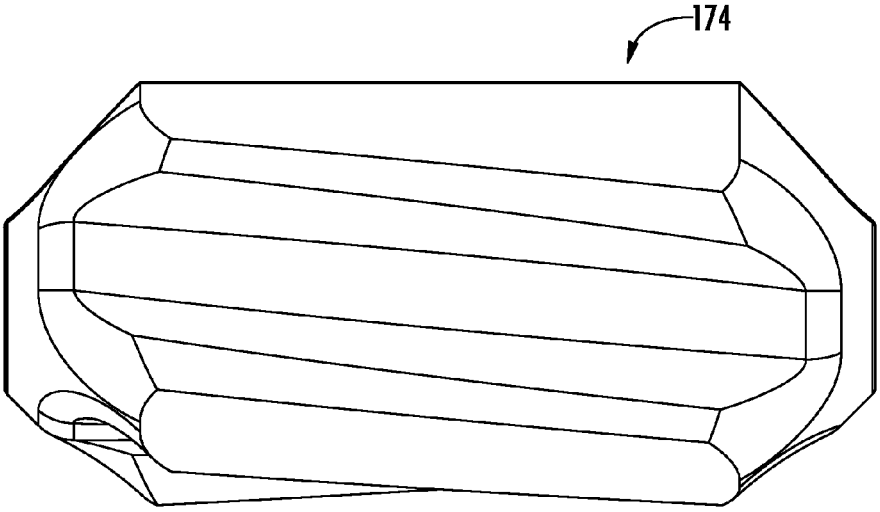
Figure 24:
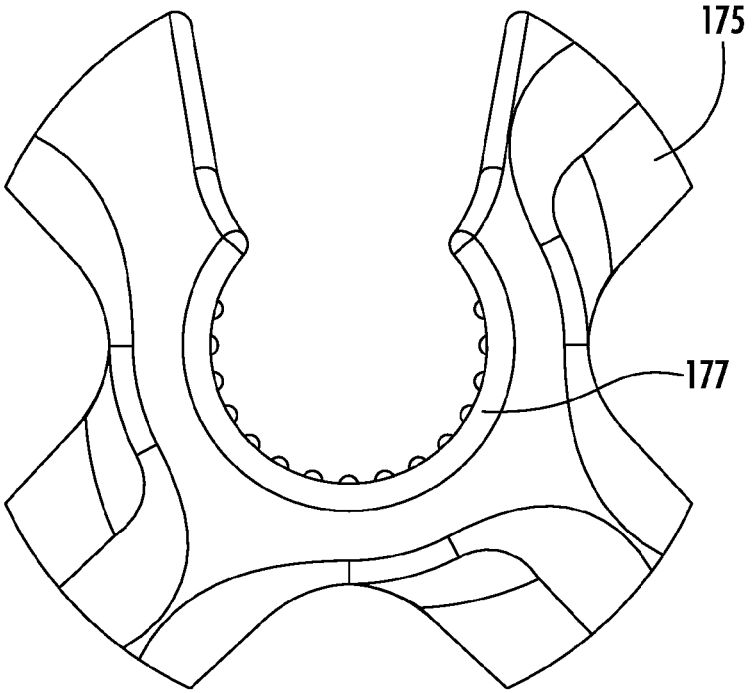
Figure 25:
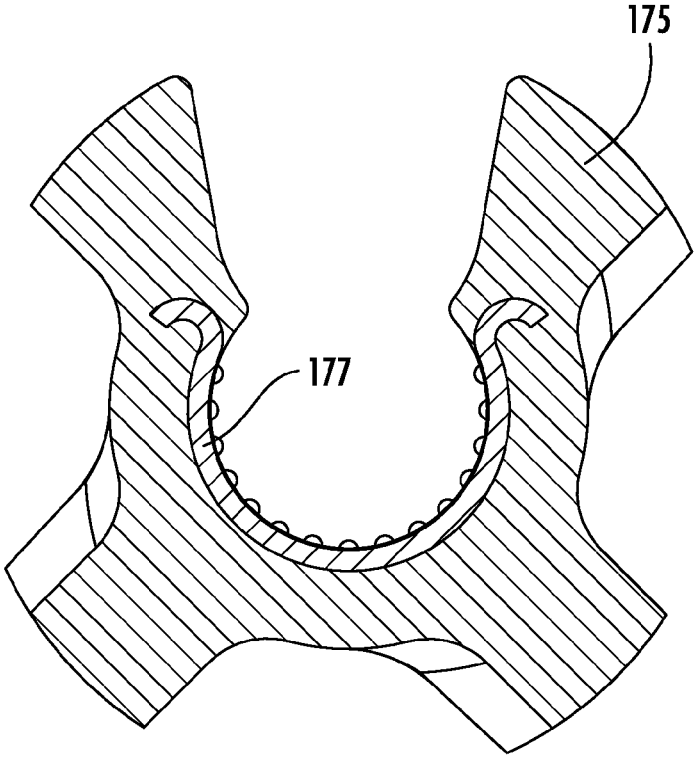

FIGS. 22 through 30*b* illustrate, generally at 174 in FIGS. 22 and 23, various views of different "snap-on" or field installable rod guides designed to fit around the narrow portion of a sucker rod shaft and to be installed after the rod is in the field rather than molded onto the rod during manufacture, after manufacture but before placement in the field, or after refurbishment. A prior art snap-on rod guide from U.S. Pat. No. 2,604,364 is illustrated in FIGS. 51 through 56, and is shown generally at 400 in FIG. 51. The prior art guide comprises a C-shaped spring steel clip 402 (FIGS. 52 through 56) for gripping the rod and a resilient body 404 of synthetic rubber. Unlike the prior art guide, the field-installed guide of FIGS. 22 through 30*b* includes a textured surface of the steel clip to increase the grip on the rod and a thermosetting resin centralizing portion having radially and helically extending fins as described above in connection with other embodiments. The thermosetting resin can be reduced not to cover the portion of the clip opposite the clip opening for receiving the rod, thus allowing reduction in the elastomer added to the resin otherwise required for flexibility and thereby increasing wear resistance and fluid flow as compared to using more elastomer.

Figure 26:
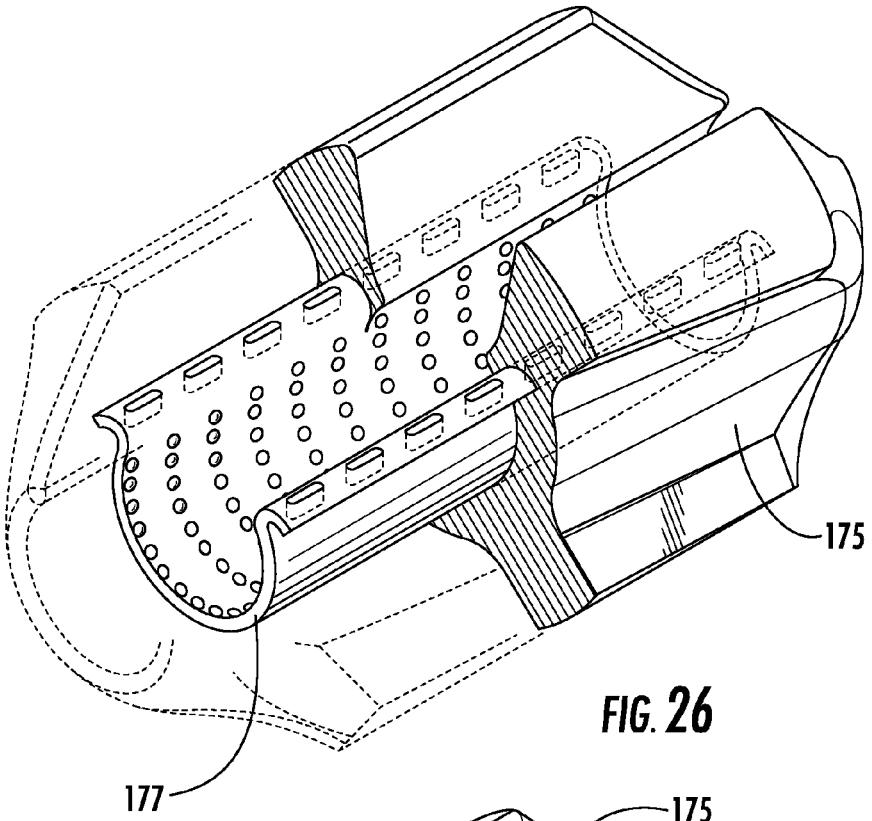
FIGS. 26 and 27 illustrate in partially isolated perspective separate embodiments of a portion of the insertion clip of FIGS. 22 through 25 extending from a transverse section through the guide.
Figure 27:
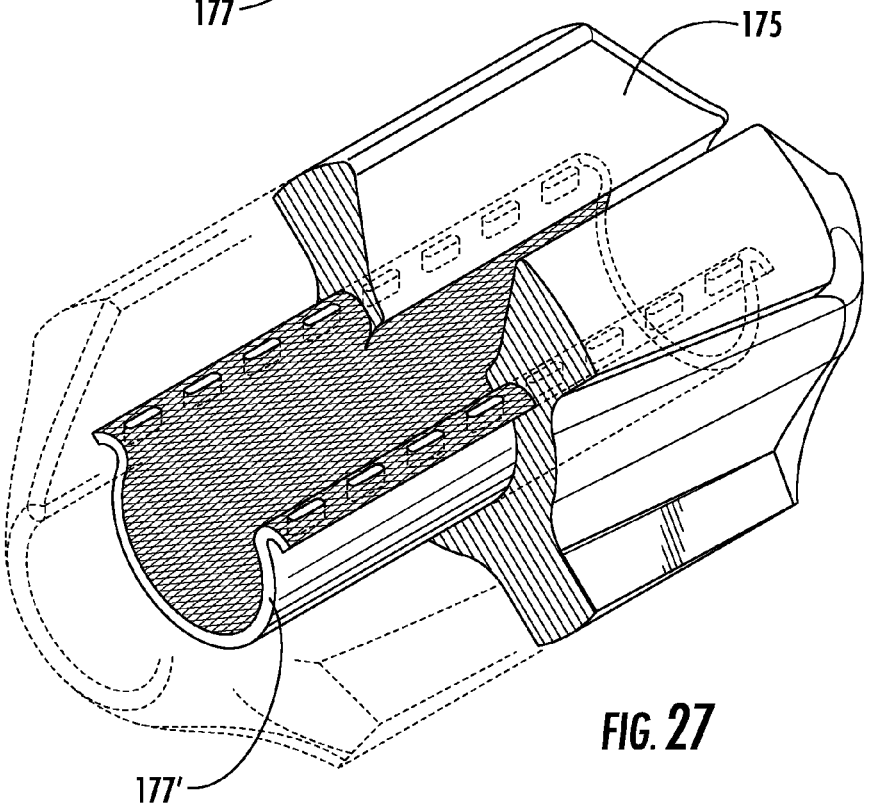
Figure 28:
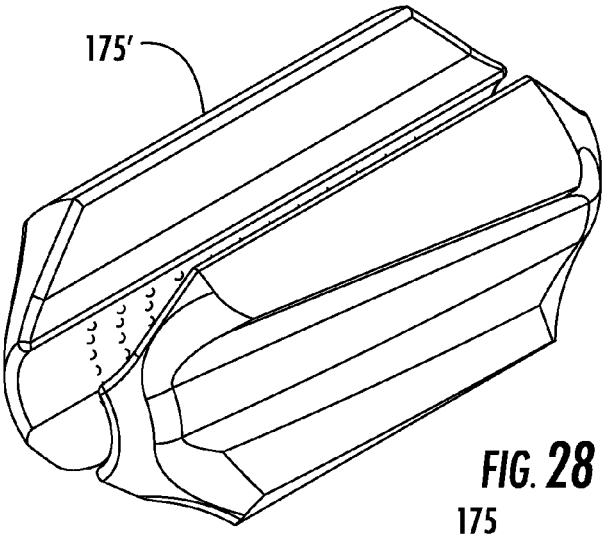
FIGS. 28, 29, and 30*a* illustrate perspective, side plan, and end plan views, respectively, of an alternative sucker rod field installable thermoset centralizing guide with a heavy-duty corrosion-resistant metal elastic insertion snap-on clip for use in connection with the invention.
Figure 29:
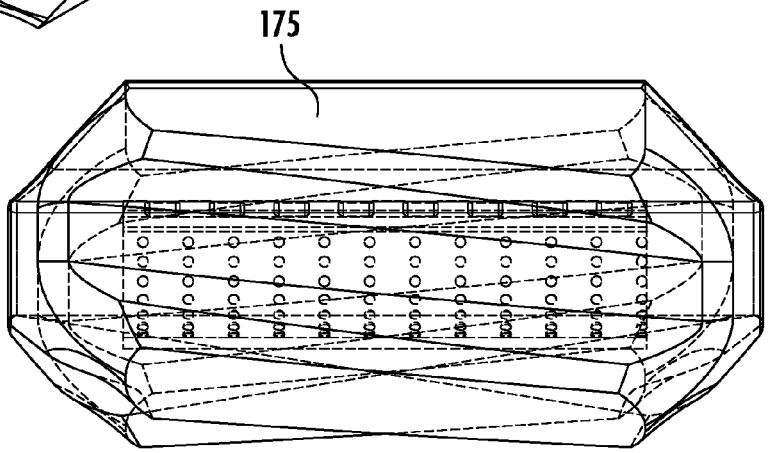

The spring steel clip of the field installed guide includes an elastic and corrosion-resistant high strength steel clip 177 with rod-gripping nipples, shown partially in shadow in FIG. 22, to act as a spring and to retain the guide in place on the rod in use. FIGS. 26 and 27 illustrate different textures of the clip surface, 177 and 177' respectively, in partially cutaway views, for increasing the grip of the elastic spring clip on the sucker rod shaft.

The elastic corrosion resistant steel clip has a cross section that is generally "C" shaped, the opening in the "C" providing a longitudinally directed channel for fitting over the slender shaft portion, the reduced-diameter portion, of a sucker rod. The elastic nature of the polymer enables the clip to open to receive the sucker rod shaft and to close tightly around it. The centralizing portion 175 in the embodiments of FIGS. 22 through 27 surround about 270° of the clip and is open above the corresponding opening in the C-shaped clip to receive the rod shaft. It is helpful to include additional elastomer in the thermosetting resin that is used to better match the flexibility of the guide to that of the spring clip. The amount of elastomer used in the thermosetting resin component of the snap-on guide of FIGS. 22 through 27 is sufficiently high to enable flexing of the elastic spring clip 177 to open to receive the rod shaft and to close to grip the rod shaft once installed. The presence of additional elastomer generally softens the resin composition and can result in faster wear and may adversely impact wear characteristics in use.

FIGS. 28 through 30*a* illustrate various views of an alternative embodiment of the field-installable snap-on rod guide that has increased wear resistance and is somewhat longer lasting than the embodiment of FIGS. 22 through 27. By eliminating a central portion at 176 of the sleeve 175' in which the elastic steel spring clip has been embedded (FIG. 30*a*), the amount of elastomer can be reduced without compromising the ability of the spring to flex, thus increasing resistance to wear and increasing flow area for crude oil simultaneously. Of course it should be recognized that the interior spring surface that engages the rod shaft has been textured by adding "nipples" to grip the rod.

Figure 30A:
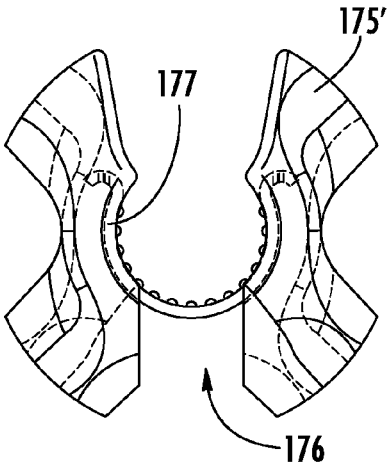
Figure 30B:
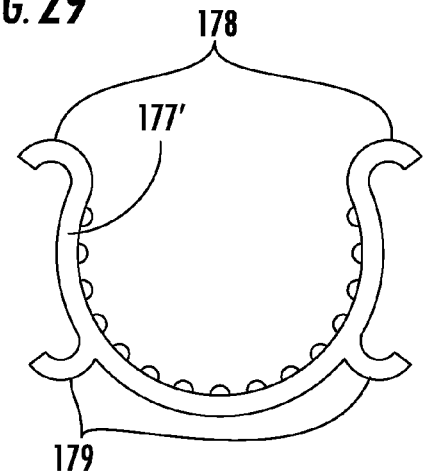
FIG. 30*b* illustrates an alternative end view of a clip portion of a field installable centralizing guide that has additional features for adhering to a thermoset molded body of the guide.

FIG. 30*b* illustrates an alternative clip 177' that can be used in any of the embodiments of FIGS. 22 through 30*b* instead of clips 177 and 177'. Clip 177' has hooked portions 178 at each end thereof adjacent the opening for receiving the rod shaft that provide a further means for securing the cured reinforced thermoset resin of the guide portion to the clip, similar to previous embodiments. Clip 177' also has minor image hooked portions 179 adjacent the opening 176 for the same purpose. These features may be prepared using stamping or welding techniques known to the fabricator art.

Figure 32:
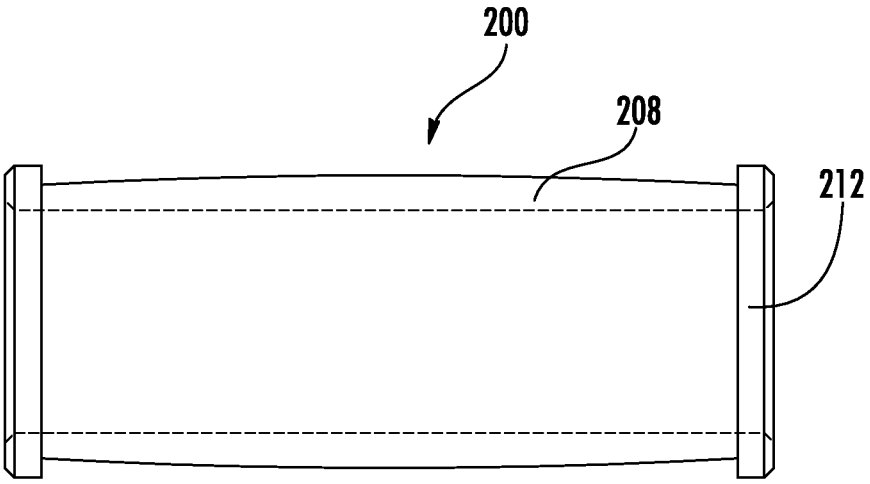
Figure 33:
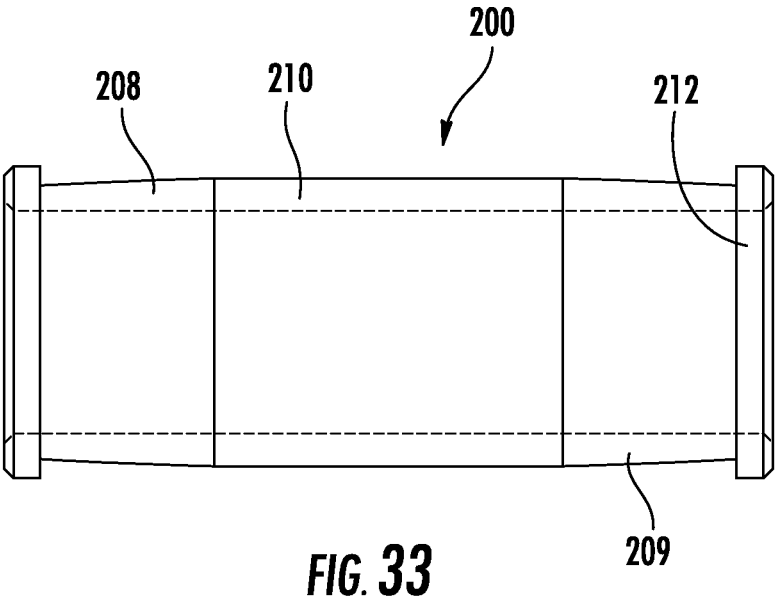
Figure 34:
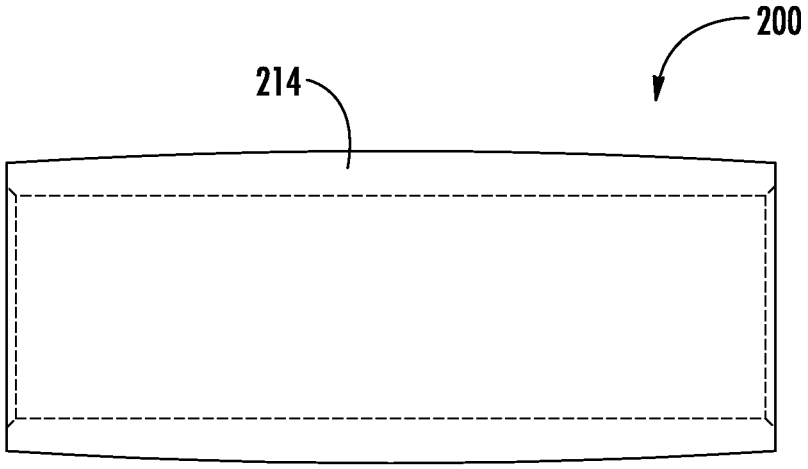

FIGS. 31 through 37 illustrate various embodiments of a coupling body shown generally at 200 that is internally threaded and has a uniform internal diameter as shown in shadow in several views and typically a radially extended diameter end cap portion 212 to define an undercut region and a stop against which a thermosetting resin applied to the undercut region may be retained on the coupling body. FIG. 34 illustrates a cambered, "football" shaped coupling that does not have the end cap stop feature and in FIG. 35, the end cap stop is of co-equal diameter to the largest diameter portion of a concave, or hourglass, coupling body.

Figure 31:
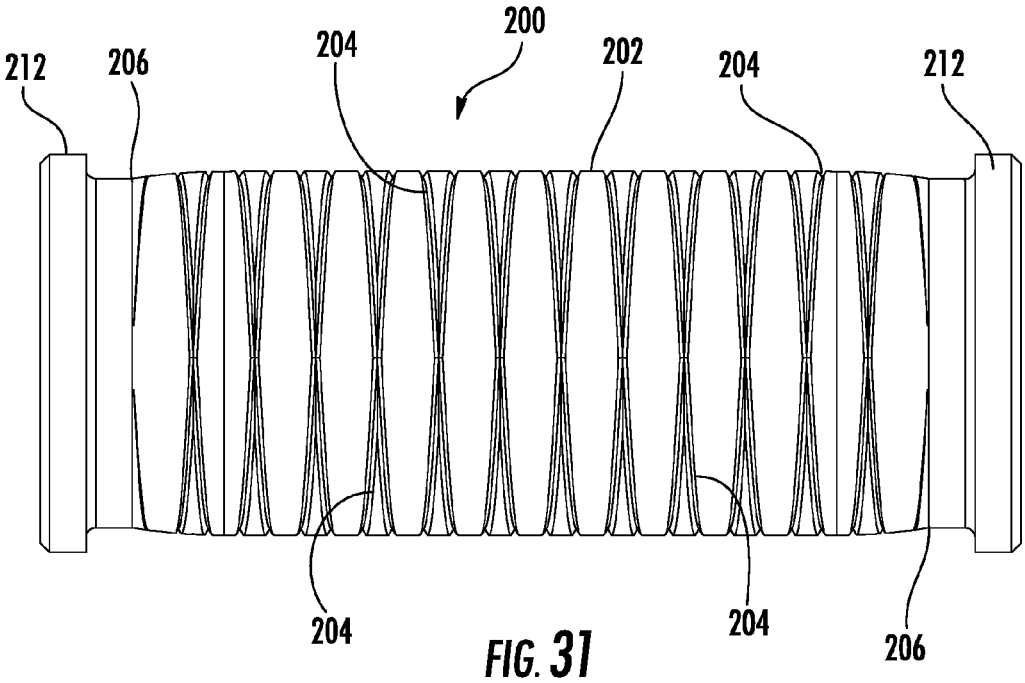
FIGS. 31, 32, 33, 34, 35, 36, and 37 illustrate in side plan view seven different embodiments of couplings of the invention having surfaces prepared for adhesion of the centralizing guide, FIG. 31 being the coupling of FIGS. 18 through 21 isolated from the guide.

FIG. 31 illustrates generally at 200 a box coupling body having a generally uniform diameter central portion 202, increased diameter end caps 212 defining a resin stop for the sleeve, and alternating clockwise and counterclockwise helical grooves 204 cut into the central surface of the coupling body to grip the thermoplastic resin sleeve molded onto the coupling (the sleeve is not shown in this view). A slight tapered portion 206 may reduce the diameter of the surface adjacent the stops 212 to increase adherence of the sleeve.

Figure 35:
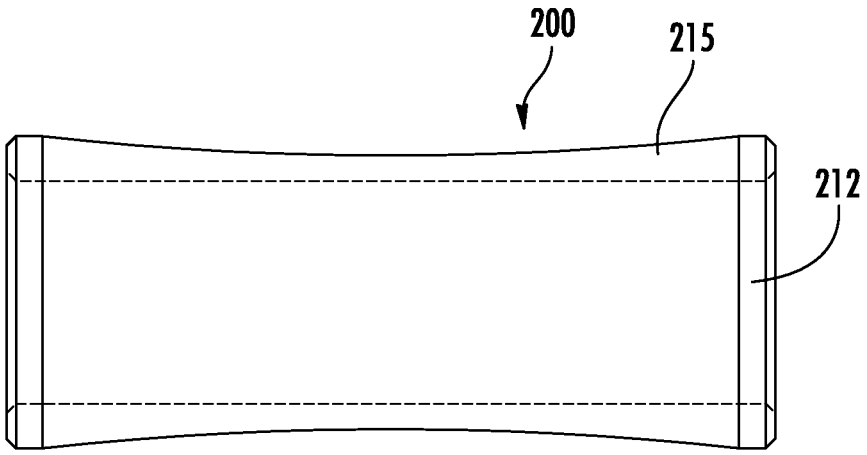

FIG. 32 illustrates a cambered external diameter 208 that includes end caps and can of course include the helical grooves of FIG. 31, if desired; FIG. 33 includes a similar embodiment with a uniform larger diameter central portion 210 and tapered end portions 209; FIG. 34 has a cambered surface 214 in the absence of end caps. FIG. 35 has a concave central portion 215 gradually increasing to the diameter of the end caps. Each of these configurations is designed to provide increased adherence to the thermosetting resin that is applied as a centralizer feature as illustrated in FIGS. 18 through 21 and, as desired, can include the helical grooves of FIG. 31, which are also shown with the thermoset composite sleeve in the sectional view of FIG. 21, which taken along lines 21-21 of end plan view FIG. 20, for the coupling of the embodiment of FIG. 31.

Figure 36:
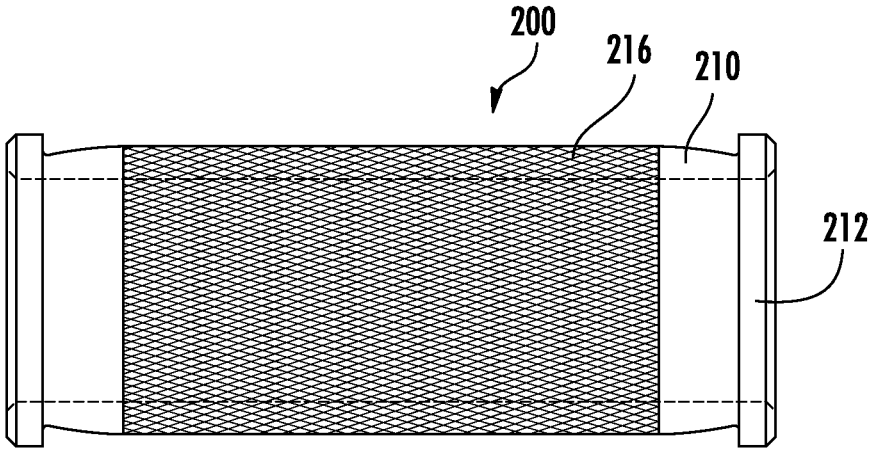
Figure 37:
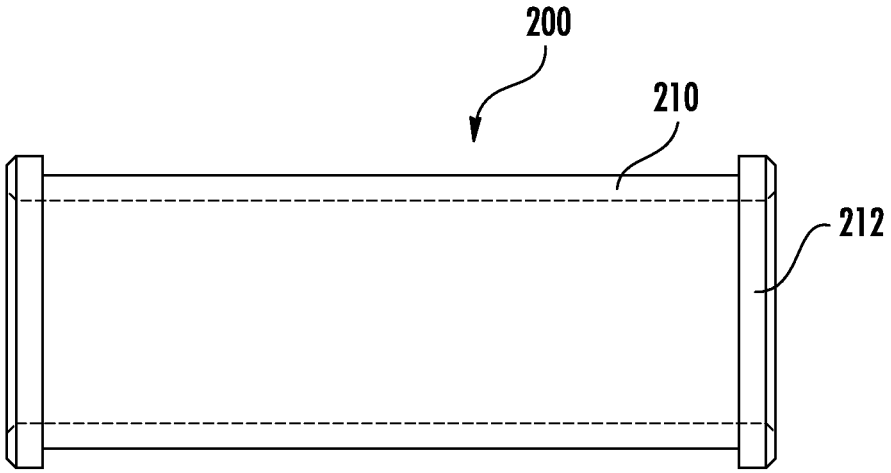

FIG. 36 illustrates an alternative textured pattern 216 in the surface of a coupling 200. FIG. 37 illustrates a coupling having a uniform outer diameter with end caps 212.

Figure 38:
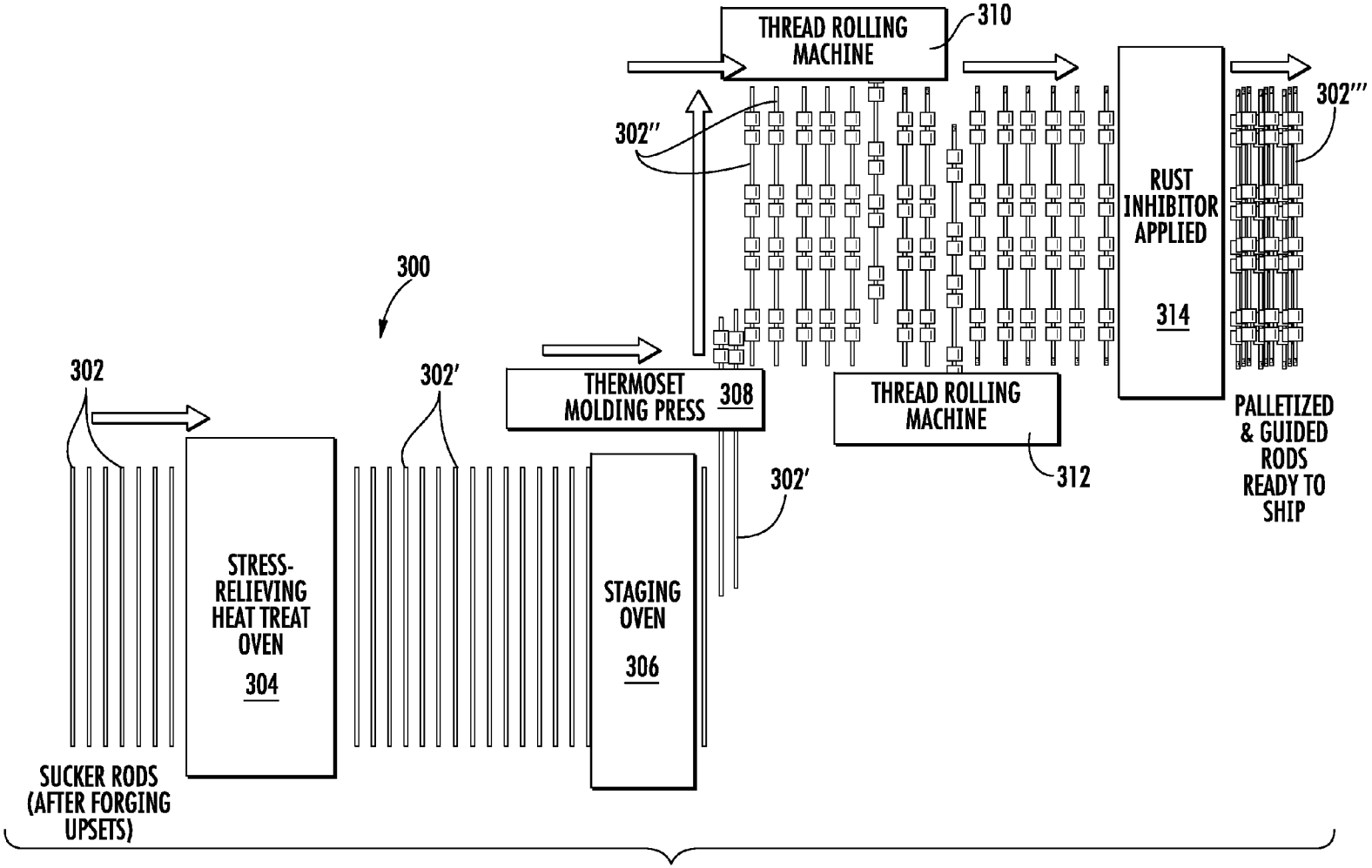
FIG. 38 illustrates schematically a process for manufacturing sucker rod segments having integrated therein steps for applying thermosetting centralizing rod guides of the invention, with or without magnets.

Turning now to a discussion of the several processes for applying thermoset resins to mold centralizing guides on sucker rods, FIG. 38 illustrates an integrated process for manufacturing sucker rods and incorporating molded-on thermosetting rod guides in the OEM manufacture of the rod. It should be recognized that centralizing guides can be molded on couplings and as sleeves on magnet rods, whether pin or box molding rods, at the time of manufacture and can be integrated into processes for manufacturing these components. Additionally, and as discussed in more detail below, processes for molding thermoset guides can be part of steps taken to recondition used sucker rods, magnet rods, and couplings so that rods, couplings and magnets are all reconditionable and reusable, thus reducing the cost of capital investment in establishing and maintaining a sucker rod pumping system and rod string in accordance with the benefits and advantages afforded herein and making these inventions more commercially viable.

We begin in FIG. 38 with a typical sucker rod manufacturing process, shown generally at 300, in which upsets, which are thickened ends formed at each end of a more slender shaft of the sucker rod, have been forged in place on the slender sucker rods 302. The direction of movement of a sucker rod 302 through the process is indicated by arrows. After the upsets are forged, the rods typically are subjected to a stress-relieving process by annealing in a furnace, which is the stress-relieving heat treat oven 304. Annealing temperatures generally are from about 1,000° F. to 1,500° F. In the practice of the invention as illustrated in FIG. 38, the annealed rods 302' are aligned and enter a staging oven 306 where they are maintained at about 300 to 400° F., generally at about 350° F., which is a suitable rod temperature for molding fiber-reinforced thermosetting resin rod guides thereon. If a magnet is to be included on the rod, the magnet normally will be placed on the rod at a predetermined location just prior to entering the staging oven so that the magnet and rod are at thermal equilibrium for molding. While any of several magnets could be used in the practice of the invention, the magnet of U.S. Patent Application Pub. No.: US 2010/0206732 is particularly useful in the practice of the invention and may be easily secured to a predetermined location on the rod shaft by fitting a matched pair of longitudinal half cylinders with arcuate inner and outer surfaces directly over the rod string and in magnetic securing contact.

Heated forged rods 302' exit the staging oven and are aligned for entering a thermoset molding press 308. Of course, thermoplastics can be used and have commonly been used for rod guides for years; however, thermosetting phenolic resins are preferred and especially so for an integrated process in which the guides are applied to heated rods as part of the process for OEM manufacturing of the rods. Any of a number of methods may be used for molding the composite materials. In the practice of the invention, transfer molding has been determined to be preferable; however, injection or compression molding or other thermoset molding techniques can be used.

The molds typically will be preheated to about 350° F. for phenolic resins, the temperature selected depending on the time required to cure the resin and complete the molding cycle. The preheated rods are aligned with the molding machine and located in the pre-heated molds for injection of thermosetting resin at predetermined intervals along the rod. Phenolic resin normally is applied at about 140° F. while the rod surface is maintained between about 300 to 400° F., and normally at about 350° F. As illustrated, rods 302' are advanced through the mold to have guides placed at various predetermined locations along the rod. Once molding is complete, the molded rods 302" having guides applied thereto are advanced to and aligned with thread rolling machines 310 and 312, one at each end of the aligned rods. While conditions and temperatures are variable depending on a variety of factors, the molding cycle normally can be completed in about 90 seconds for each individual molded centralizing guide. Thereafter, an additional batch of rods enters the molds.

Once cooled to ambient, each upset rod end is machined to pins, threads are rolled in the pins, and the rod is dipped, sprayed, or painted to preclude rust, as illustrated at rust inhibitor dip tank 314. In some operations, the threads may be lightly greased and capped for protection. Finished rods 302''' are placed on pallets and the rods with guides stacked on pallets are then shipped to the well site on demand.

Figure 39:
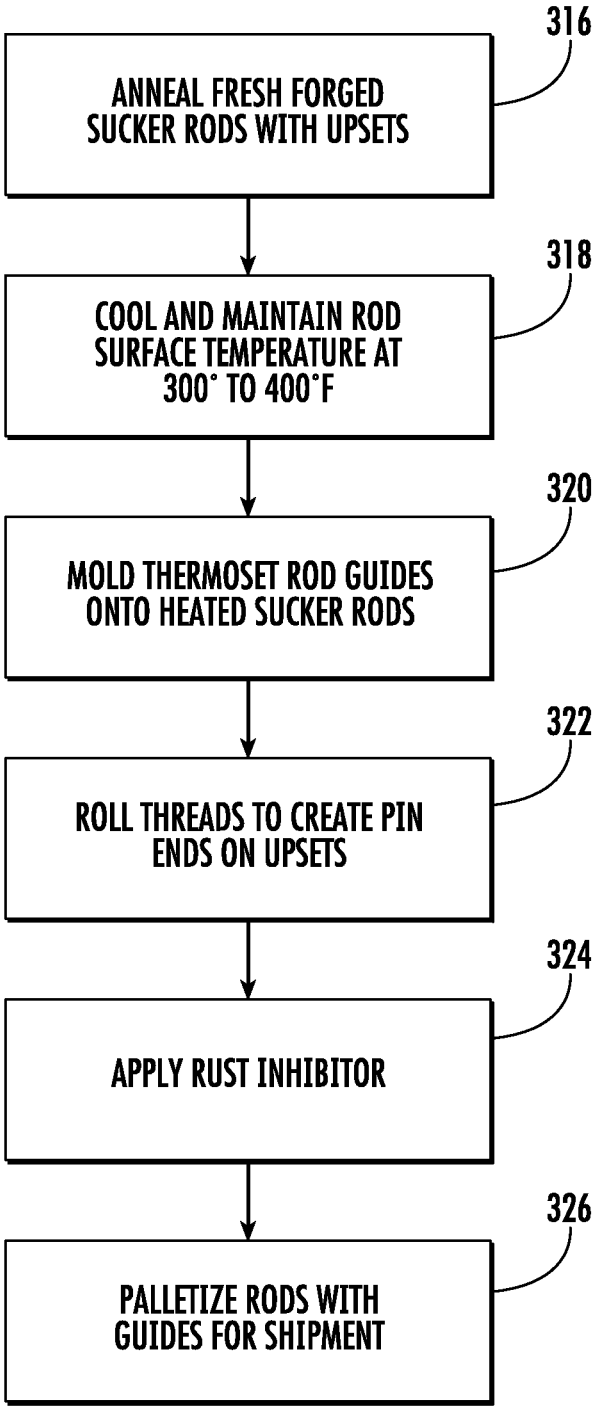
FIG. 39 is a flow diagram illustrating the steps associated with the schematic of FIG. 38.

The steps of the process described and illustrated in FIG. 38 are further illustrated in a flow diagram in FIG. 39. In accordance with step 316, fresh sucker rods forged with upsets in place are annealed at elevated temperature to harden and strengthen the rods. The rod surface temperature thereafter is cooled and maintained at 300 to 400° F., step 318, so that rod guides of fiber-reinforced thermosetting resin, including for example, Bakelite reinforced with glass fiber, may be molded on the heated sucker rods in accordance with step 320. Once the rods have advanced through the molding station, the rods are cooled and threads are rolled in pins at each upset end, step 322. Rust inhibitor may be applied as desired, step 324, and the finished rods with guides molded thereto placed on pallets for shipment, step 326.

Figure 40:
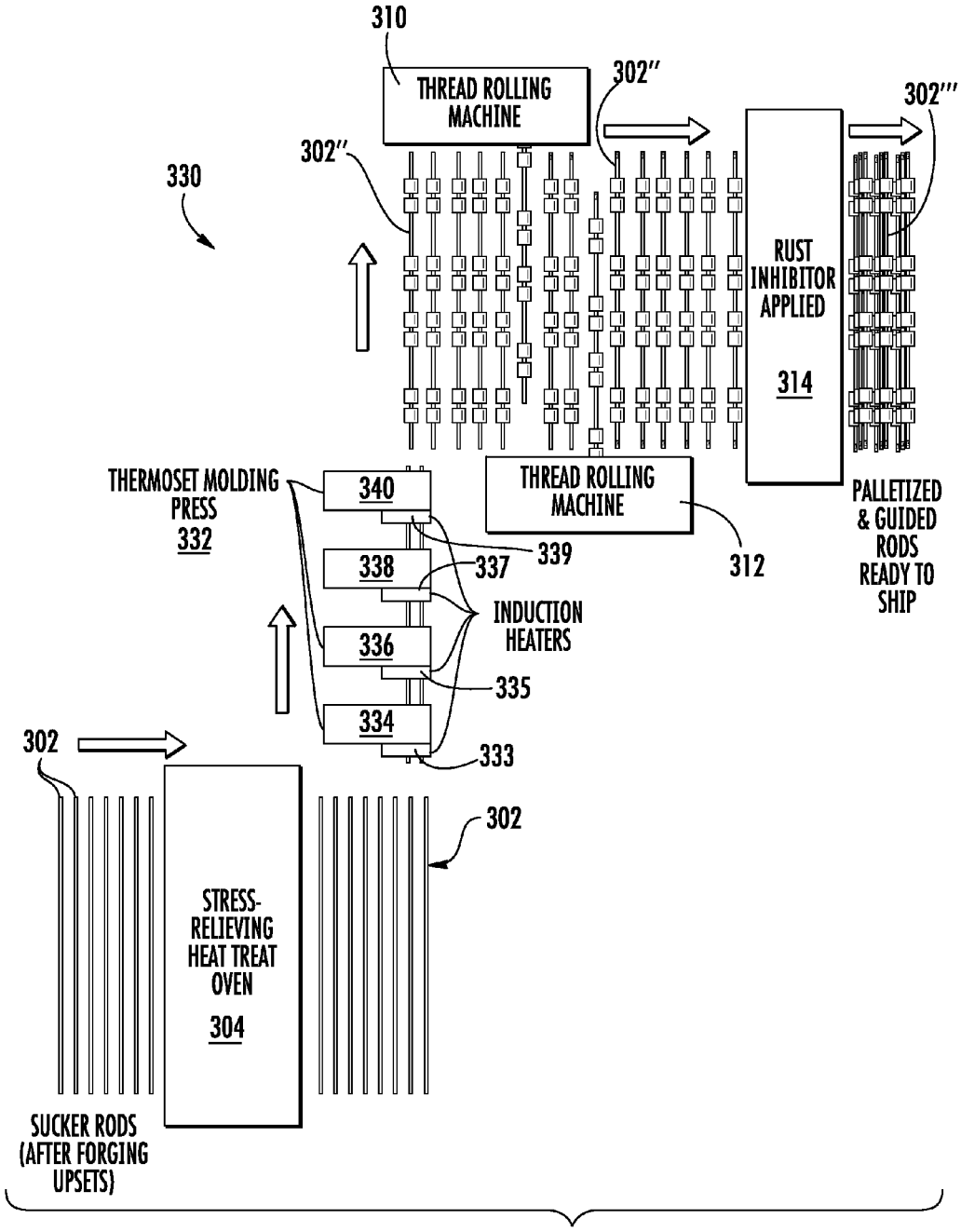
FIG. 40 is an alternative embodiment to the process schematic of FIG. 38 and illustrates induction heaters at each molding press rather than a staging oven to maintain rod temperature.

FIG. 40 illustrates an alternative embodiment to the sucker rod OEM manufacturing process of FIG. 38, shown generally at 330. In many respects, the processes are identical and incorporate the steps of forging sucker rods, rolling threads in the pins, and shipping the rods in lots mounted on pallets. Sucker rods 302 with forged upsets are subjected to a stress-relieving process by annealing in a furnace, which is the stress-relieving heat treat oven 304, similar to FIG. 38. The direction of movement of a sucker rod 302 through the process is indicated by arrows. After annealing, unlike in FIG. 38, the annealed rods do not enter a staging oven, but are aligned to enter a thermoset molding press or presses 332. The thermoset molding press is illustrated with four separate molds 334, 336, 338, and 340 for applying multiple guides simultaneously to the sucker rod, although it should be recognized that more or less can be included as desired.

For example, with four presses, each press molding guides on two parallel rods simultaneously, eight guides may be molded at one time. A twenty-five food rod can be transmitted through the mold to have four guides applied at once and then indexed for application of another four guides, if desired. Each molding station has associated therewith an induction heater, heater 333 with molding station 334, and so on. The induction heaters heat the surface of each sucker rod locally to about 350 to 400° F., as required.

Figure 41:
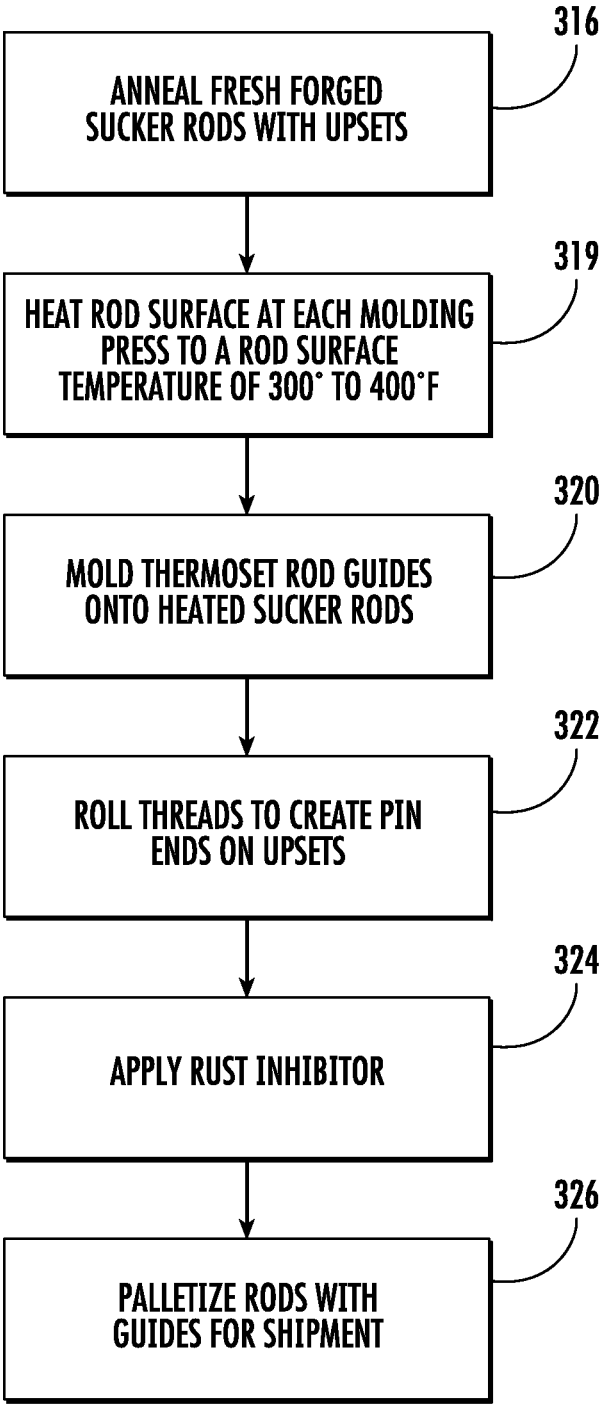
FIG. 41 illustrates the steps of the process illustrated schematically in FIG. 40.

FIG. 41 illustrates the process steps associated with the method of FIG. 40, which in many cases are the same as described for FIG. 39 and are similarly numbered. However, in step 319, unlike step 318 of FIG. 39, the rod surfaces are heated at each molding press to a temperature of 300 to 400° F. for application of thermoset composite resin and curing.

Figure 42:
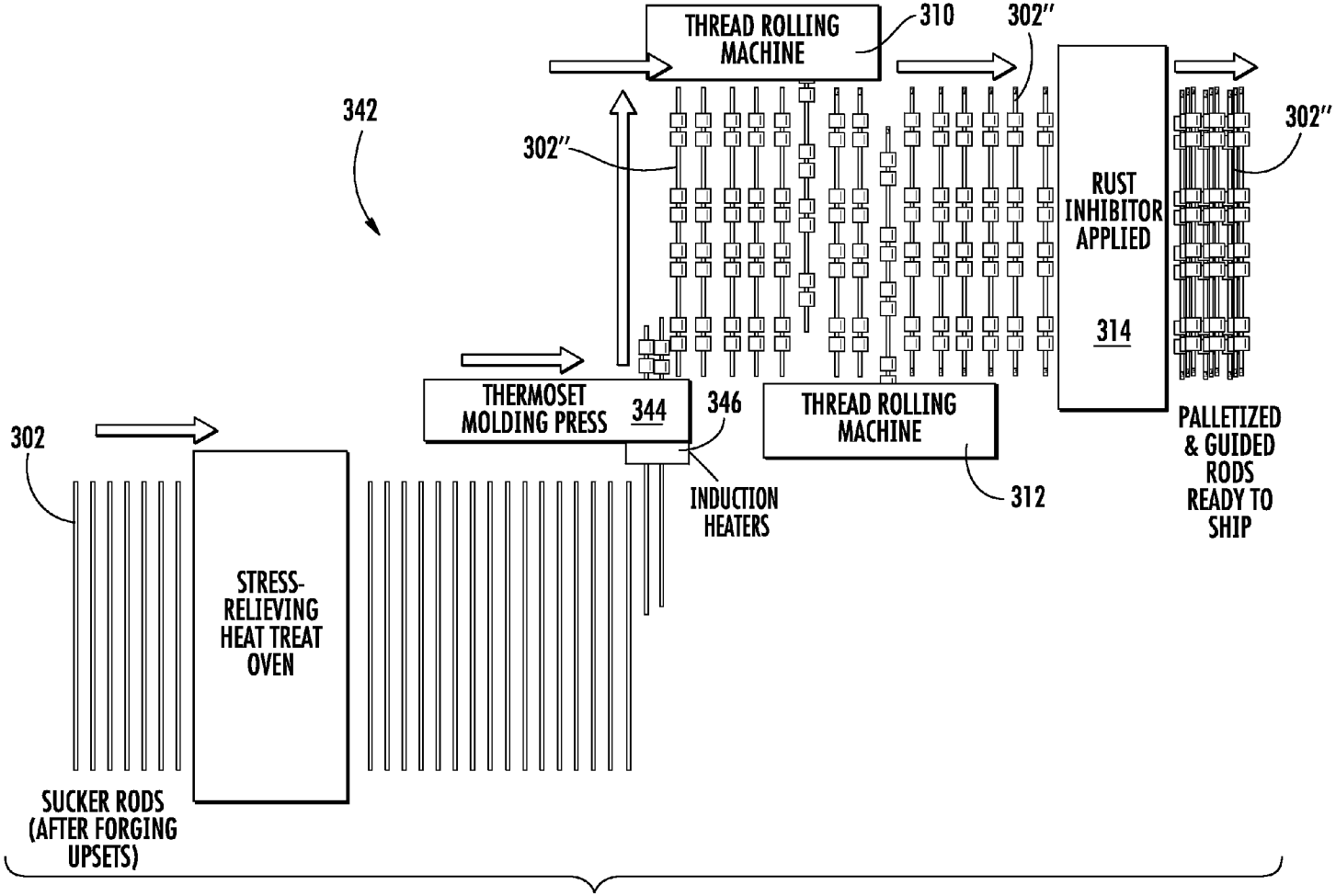
FIG. 42 is a schematic of an alternative process that illustrates a single induction heater at the entrance to the molding press.

FIG. 42 illustrates yet another alternative embodiment to the sucker rod manufacturing processes of FIGS. 38 and 40, shown generally at 342. In many respects, the processes are identical and incorporate the steps of forging sucker rods, rolling threads in the pins, and shipping the rods in lots mounted on pallets. Sucker rods 302 with forged upsets are subjected to a stress-relieving process by annealing in a furnace, which is the stress-relieving heat treat oven 304, similar to FIGS. 38 and 40. The direction of movement of a sucker rod 302 through the process is indicated by arrows. After annealing, unlike in FIGS. 38 and 40, the annealed rods do not enter a staging oven or multiple presses with an induction heater at each press, but are aligned to enter a single thermoset molding press 344 that includes a single induction heater 346 at the entrance for preheating the rod surface prior to entry to the molding press. The remainder of the processes of FIGS. 38, 40 and 42 are the same.

Figure 43:
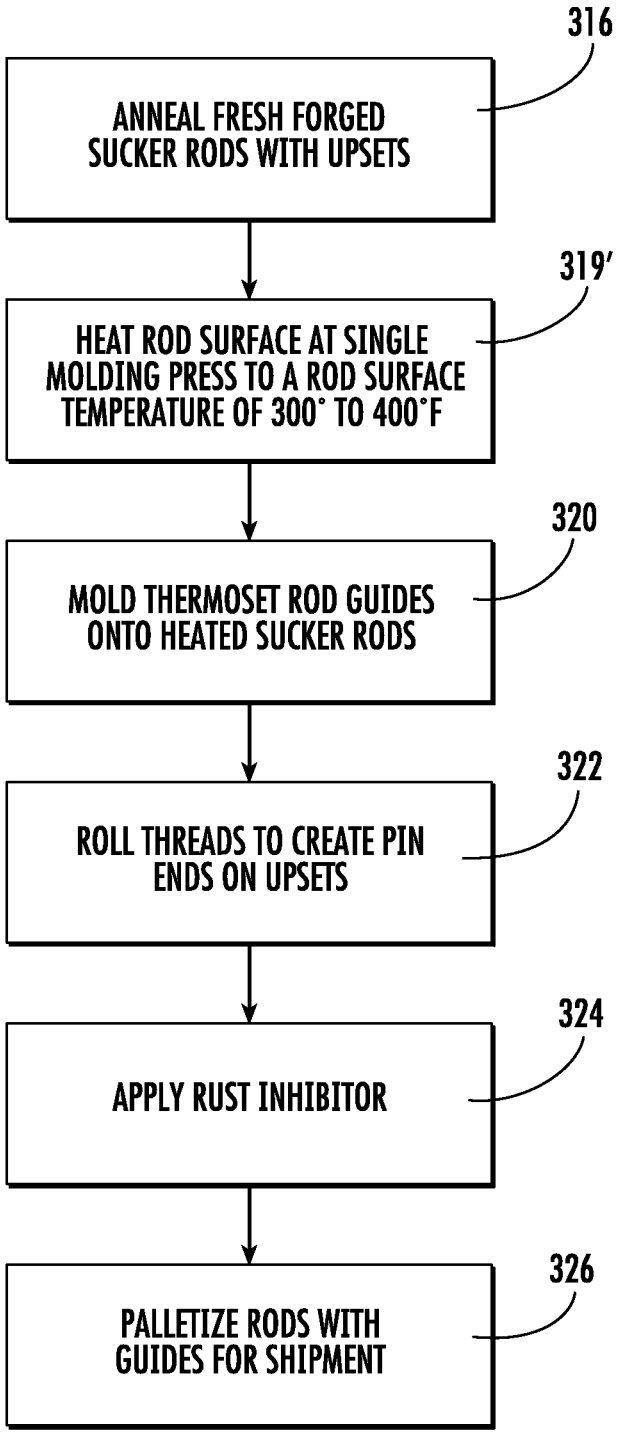
FIG. 43 illustrates the steps of the process illustrated schematically in FIG. 42.

FIG. 43 illustrates the process steps associated with the method of FIG. 42, which in many cases are the same as described for FIGS. 39 and 41 and are similarly numbered. However, in step 319', unlike step 318 of FIG. 39 and 319 of FIG. 41, the rod surfaces are heated at each molding press step to a temperature of 300 to 400° F. for application of thermoset composite resin and curing one at a time.

Figure 44:
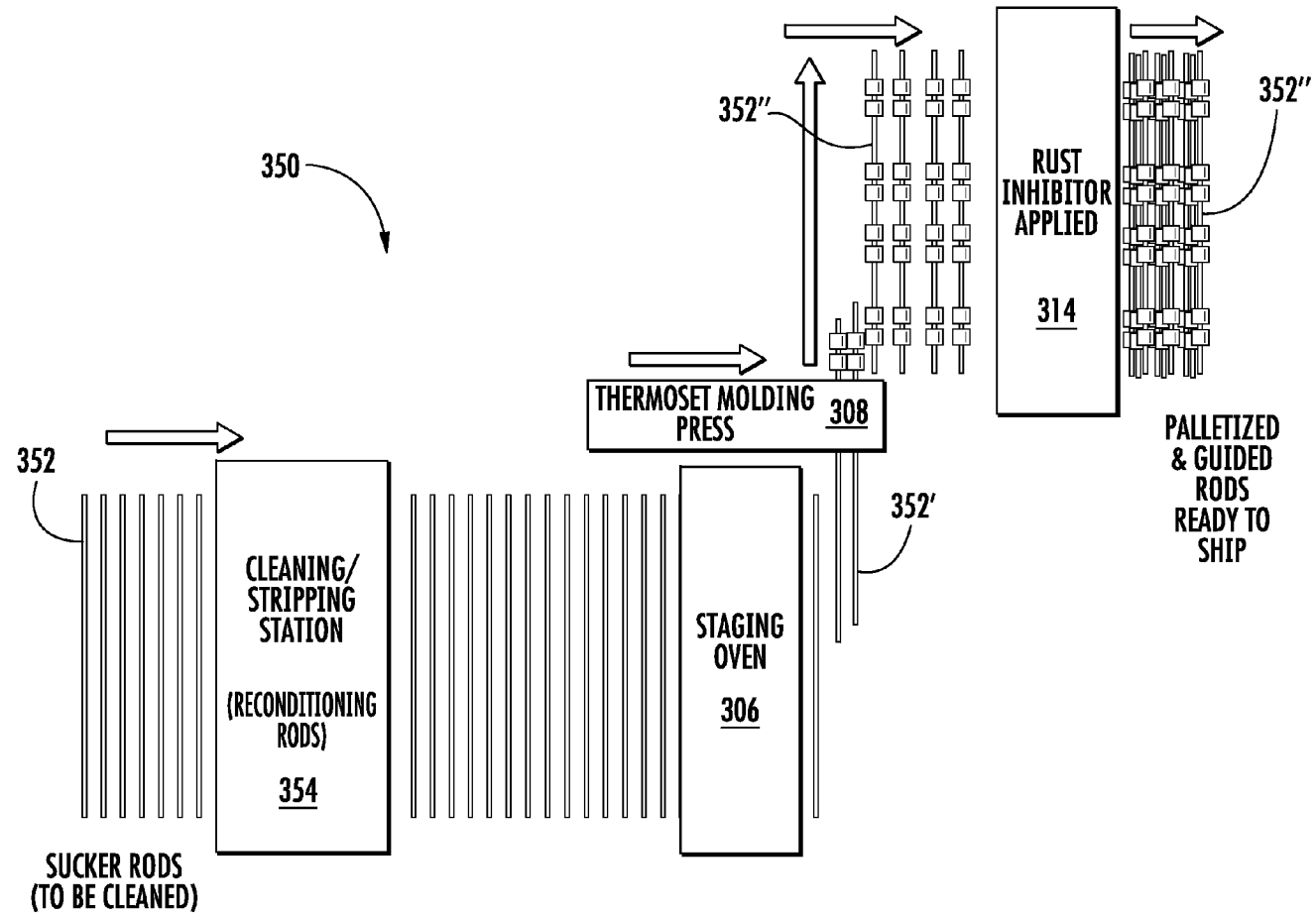
FIG. 44 illustrates a process for reconditioning used sucker rod segments having integrated therein steps for applying thermosetting centralizing rod guides of the invention, with or without magnets, and in which the rods are held at temperature for molding on of rod guides.

Turning now to the steps of a process for reconditioning used rods and applying guides to them, FIG. 44 illustrates generally at 350 the schematic of a process for processing and reconditioning used rods. Sucker rods 352 generally are aligned for stripping and cleaning and enter a cleaning and stripping station 354. The cleaned rods can then be processed, as shown by the direction arrows, through a staging oven 306, identical to that of FIG. 38, to heat the rods to molding temperature, normally to about 300 to 400° F., generally about 350° F. Thereafter, the molding arrangements previously illustrated in FIG. 38 can be used and the rods with guides 352" are processed as previously described in connection with FIG. 38 for rods 302", with the exception that no threads need be rolled since these rods are used or previously manufactured and already have threads rolled in the pins.

Figure 45:
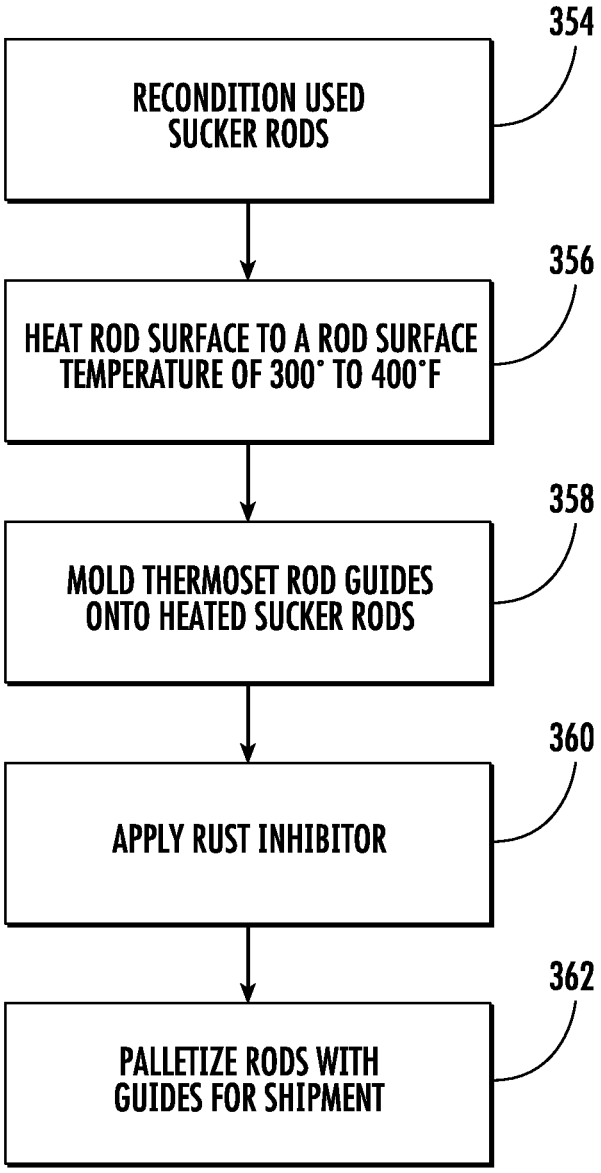
FIG. 45 illustrates the steps of the process illustrated schematically in FIG. 44.

FIG. 45 illustrates the steps associated with the method schematically shown in FIG. 44. Sucker rods are reconditioned in accordance with step 354, which includes cleaning and stripping the rods. In the case of magnet rods and sucker rods with magnets, the reconditioning step 354 may include machining the old thermoset sleeve down to the stop previously described, so as not to damage the magnet, to prepare the magnet for receiving a new sleeve and guide. Thereafter, the rod surface or the rod surface with a magnet applied, as the case may be, are heated to a surface temperature of 300 to 400° F. to prepare the surface for receiving a phenolic thermoset composite resin, step 356. Rod guides of thermosetting resin are molded onto the heated sucker rods, step 358. As described previously, rust inhibitor is applied and the finished, now refurbished or previously manufactured rods are placed on pallets for shipping, step 362.

Figure 46:
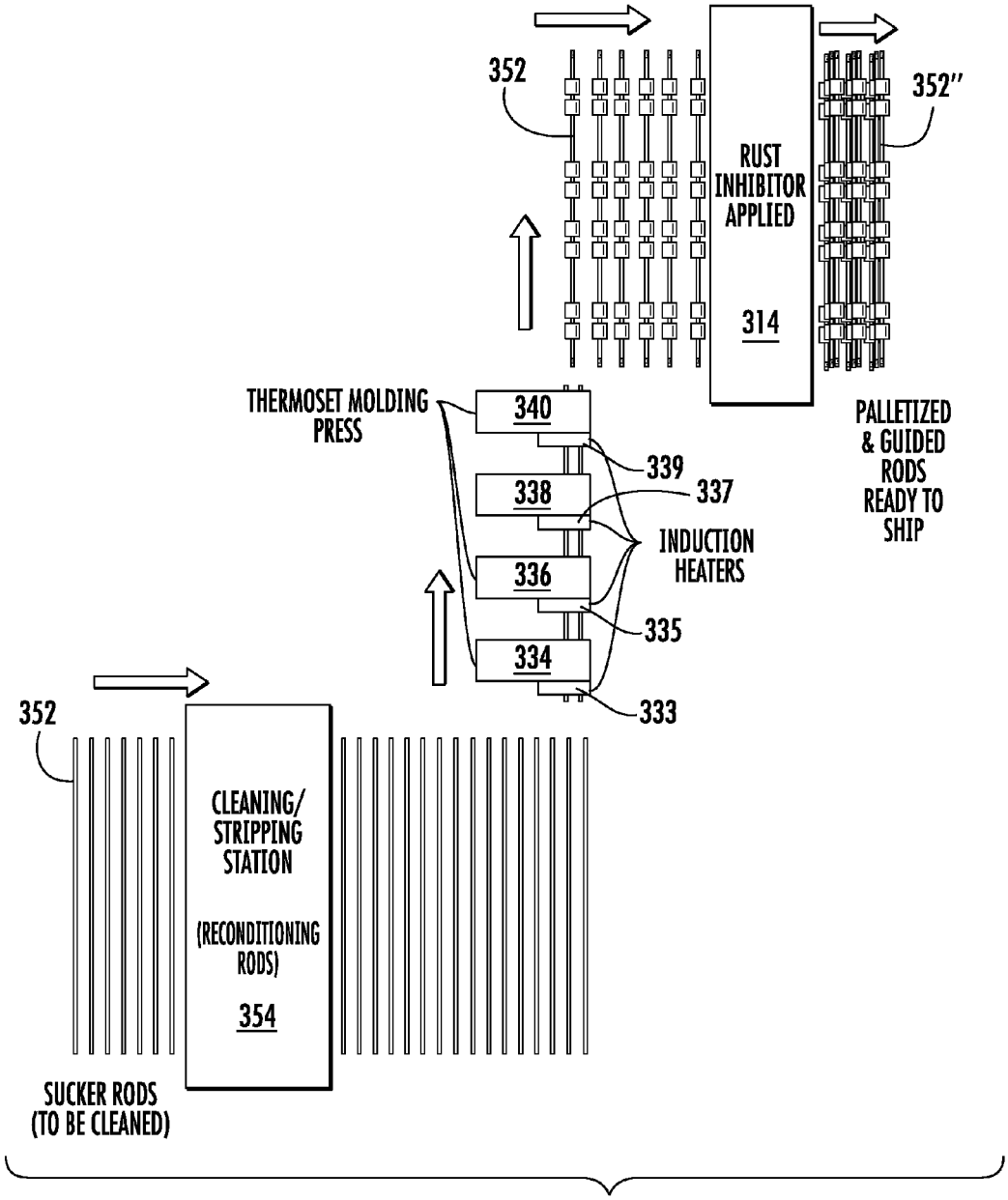
FIG. 46 is an alternative embodiment to the process of FIG. 44 and uses induction heaters at each molding press rather than a staging oven to maintain rod temperature for the reconditioned rods.
Figure 48:
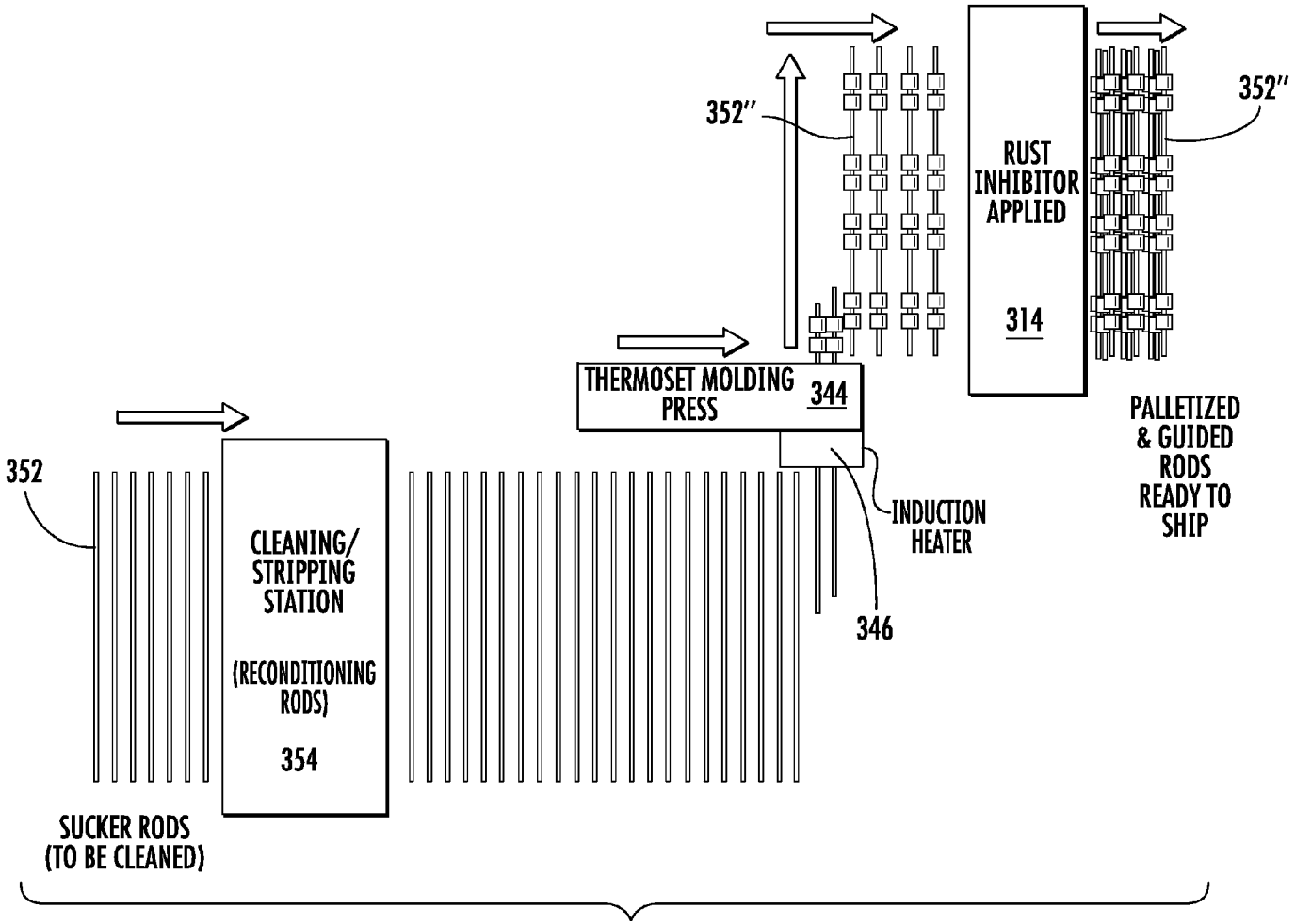
FIG. 48 is an alternative embodiment that uses a single induction heater at a single molding press for the reconditioned rods.

FIGS. 46 and 48 are illustrations of additional and alternative embodiments for reconditioning used rods that incorporate the various thermoset molding arrangements 333 through 340 and 344, 346, respectively, previously illustrated in connection with FIGS. 40 and 42, respectively, for molding guides on new rods, heating the rod surfaces by induction at the molds rather than in a separate staging oven. Similar parts bear similar numbers throughout.

Figure 47:
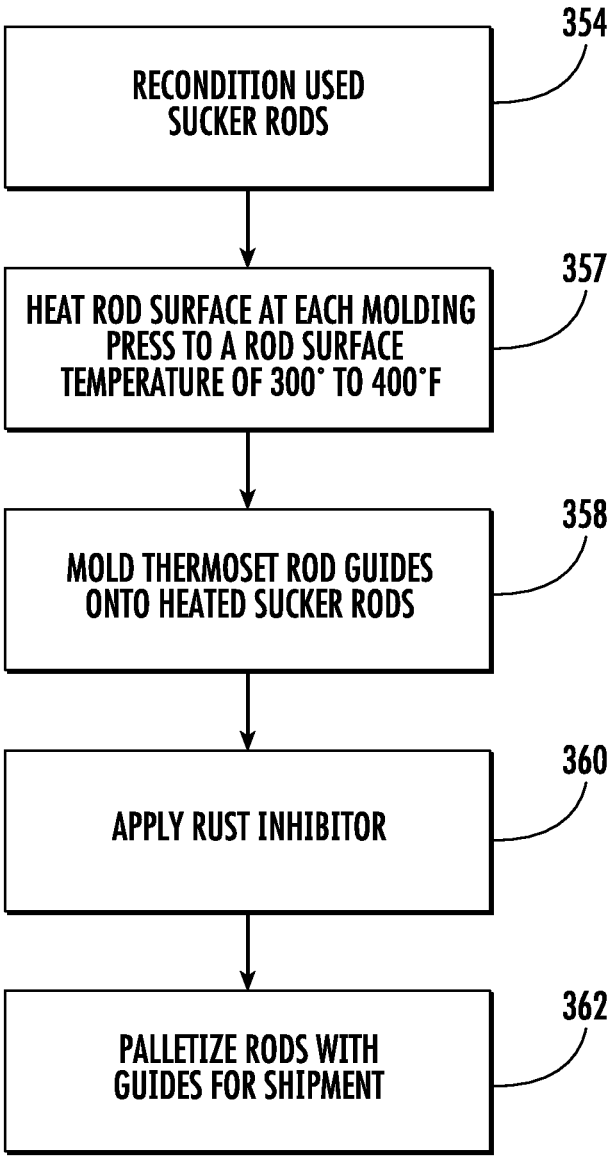
FIG. 47 illustrates the steps of the process illustrated schematically in FIG. 46.
Figure 49:
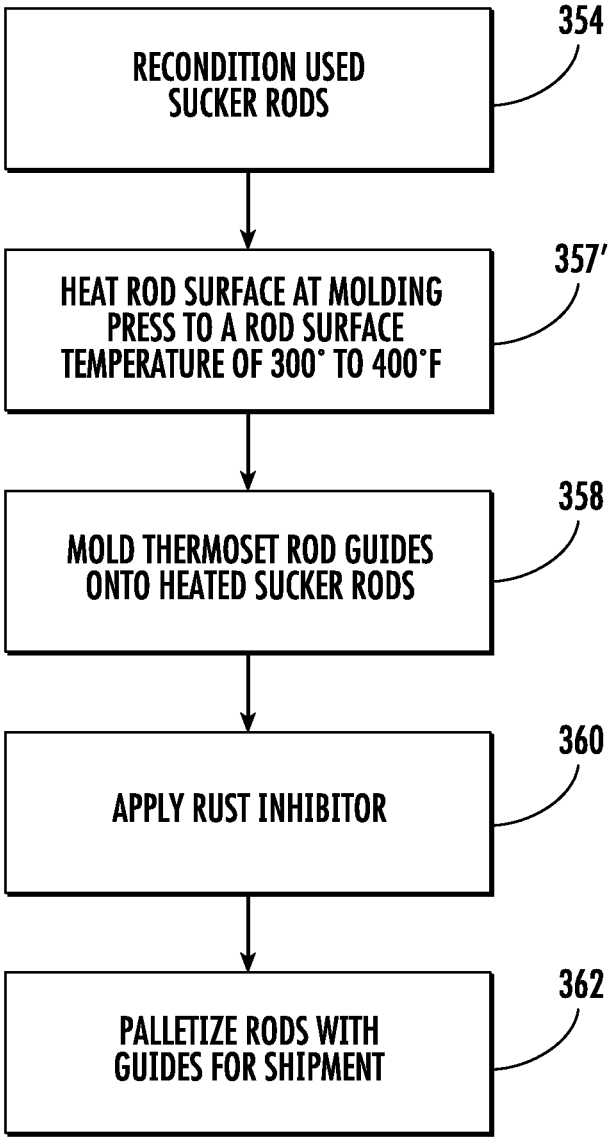
FIG. 49 illustrates the steps of the process illustrated schematically in FIG. 48.

Process steps are illustrated in FIGS. 47 and 49 corresponding to FIGS. 46 and 48, respectively, the differences from the description of the process of FIG. 45 being the use of induction heaters at the molding stations rather than a staging oven as shown in FIG. 45.

It should be recognized that the technologies addressed above, including the magnet rod inserts and the reinforced phenolic guides for rods, couplings, and magnet rod insert, are a way to improve the recovery of fluids from underground reservoirs without using or at least reducing the harsh chemicals often used to alleviate unproductive wells. The guides assist wells in performing to an optimum production level while minimizing tubing, rod and coupling wear. The magnet rods control, manage, and even reverse corrosion, scaling, paraffin accumulation, and the build-up of microbial contaminants. Chemical and hot oil treatments and manual cleaning and clearing methods can largely be reduced and/or eliminated, thus making practice of the invention more environmentally attractive than many alternatives.

It should be recognized that the centralizing rod guides, couplings, centralizing rods with magnets, and magnet rod inserts, box and pinned, can be used separately or together and in connection with sucker rod pumping of any fluid. Composite phenolic resins can be used on some or all the components or the components may, if desired, use thermoplastic components, although not necessarily with equivalent results. It should be understood that the specific embodiments illustrated herein have been selected to illustrate and not to limit the invention, the spirit and scope of which is defined by the appended claims.

What is claimed is:

1. A sucker rod for a rod string for a sucker rod pumping system, the sucker rod comprising a longitudinally extending shaft portion terminated by upsets defining externally threaded pins, the shaft portion generally being of reduced diameter compared to the upsets, and wherein the sucker rod has fixed thereto about the reduced-diameter shaft portion at least one guide adapted for centering the sucker rod coaxially within a production tube of a sucker rod pumping system and forming an annular space between the sucker rod and the interior surface of a production tube, the guide comprising a fiber reinforced thermoset polymer composite matrix having at least two generally longitudinally directed fins extending radially from the sucker rod and defining passages therebetween for the passage of fluid, the fins engaging the interior surface of the production tube opposite the rod and defining sacrificial wear surfaces against the production tube.

2. The sucker rod of claim 1 wherein said fiber reinforced thermoset polymer composite matrix comprises one or more phenolic resins.

3. The sucker rod of claim 1 wherein said fiber reinforced thermoset polymer composite matrix comprises fiber selected from the group consisting of glass fiber, carbon fiber, para-aramid fiber, basalt, fruit fiber, wool fiber, wood fiber and mixtures thereof.

4. The sucker rod of claim 1 wherein said fiber reinforced polymer composite matrix further comprises particulate matter selected from the group consisting of minerals, nanocomposites, and mixtures thereof.

5. The sucker rod of claim 1 wherein said fiber reinforced thermoset polymer composite matrix comprises a fiber-reinforced phenolic resin reinforced with glass fiber and minerals.

6. The sucker rod of claim 1 wherein said fiber reinforced thermoset polymer composite matrix comprises a phenolic resin reinforced with glass fiber and minerals and having one or a mixture of substances selected from the group consisting of carbon black, coal dust, graphite, mica, talc, wood flour, and mixtures thereof.

7. The sucker rod of claim 1 wherein said guide is a fiber reinforced thermoset polymer matrix comprising a phenolic resin, the guide formed by a process selected from the group consisting of compression molding, injection molding, and transfer molding.

8. The sucker rod of claim 1 wherein said guide is a fiber reinforced thermoset polymer composite matrix formed by molding the matrix about the sucker rod in a thermoset molding press having spaced-apart molding stations for simultaneously molding multiple spaced-apart guides at preselected locations on one or more sucker rods.

9. The sucker rod of claim 8 wherein said guide is formed in a thermoset molding press for simultaneously molding the fiber reinforced composite matrix about multiple sucker rods in parallel.

10. The sucker rod of claim 8 wherein said guide is formed in a thermoset molding press for simultaneously molding the fiber reinforced composite matrix at preselected locations on one or more sucker rods and the one or more rods are indexed through the press.

11. The sucker rod of claim 8 wherein each molding station is associated with an induction heater for heating the surface of each sucker rod locally within the molding station.

12. The sucker rod of claim 8 wherein the molding press is a thermoset transfer molding press.

13. A sucker rod for a rod string for a sucker rod pumping system, the sucker rod comprising a longitudinally extending shaft portion terminated by upsets defining externally threaded pins, the shaft portion generally being of reduced diameter compared to the upsets, and wherein the sucker rod has fixed thereto about the reduced-diameter shaft portion at least one guide adapted for centering the sucker rod coaxially within a production tube of a sucker rod pumping system and forming an annular space between the sucker rod and the interior surface of a production tube, the guide comprising a glass fiber and mineral reinforced thermoset phenolic polymer composite having at least two generally longitudinally directed fins extending radially from the sucker rod and defining passages therebetween for the passage of fluid, the fins engaging the interior surface of the production tube opposite the rod and defining sacrificial wear surfaces against the production tube, wherein the guide is compression molded, injection molded, or transfer molded onto the rod.

14. The sucker rod of claim 13, wherein the guide fixed to the rod is transfer molded onto the rod.

15. A sucker rod for a rod string for a sucker rod pumping system, the sucker rod comprising a longitudinally extending shaft portion terminated by upsets defining externally threaded pins, the shaft portion generally being of reduced diameter compared to the upsets, and wherein the sucker rod has fixed thereto about the reduced-diameter shaft portion at least one molded guide adapted for centering the sucker rod coaxially within a production tube of a sucker rod pumping system and forming an annular space between the sucker rod and the interior surface of a production tube, the guide comprising a glass fiber and mineral reinforced thermoset phenolic polymer composite matrix and having at least two generally longitudinally directed fins extending radially from the sucker rod and defining passages therebetween for the passage of fluid, the fins engaging the interior surface of the production tube opposite the rod and defining sacrificial wear surfaces against the production tube, wherein the guide is formed by transfer molding the matrix about the sucker rod in a thermoset molding press having spaced-apart molding stations for simultaneously molding multiple spaced-apart guides on one or more sucker rods, each molding station associated with an induction heater for heating the surface of each sucker rod locally.

16. The sucker rod of claim 15 wherein said guide is formed in a thermoset molding press for simultaneously molding the fiber and mineral reinforced composite matrix about multiple sucker rods in parallel.

17. The sucker rod of claim 15 wherein said guide is formed in a thermoset molding press for simultaneously molding the fiber and mineral reinforced composite matrix at preselected locations on one or more sucker rods and the one or more rods are indexed through the press.

* * * * *